US005787977A

United States Patent [19]

Yuasa et al.

[11] Patent Number: 5,787,977

[45] Date of Patent: Aug. 4, 1998

[54] HEAT EXCHANGER

[75] Inventors: Munenori Yuasa; Shinichi Hamada, both of Anjo; Akira Uchikawa, Nagoya; Yasutoshi Yamanaka, Kariya, all of Japan

[73] Assignee: Nippondenso Co., Ltd., Japan

[21] Appl. No.: 41,247

[22] Filed: Apr. 1, 1993

[30] Foreign Application Priority Data

Apr. 2, 1992 [JP] Japan ..... 4-081138
May 28, 1992 [JP] Japan ..... 4-136629

[51] Int. Cl.[6] ..... F28F 3/08

[52] U.S. Cl. ..... 165/284; 165/165; 165/167; 165/908; 165/916

[58] Field of Search ..... 165/165, 164, 165/166, 167, 51, 916, 284, 908

[56] References Cited

U.S. PATENT DOCUMENTS

| | | | |
|---|---|---|---|
| 3,743,011 | 7/1973 | Frost . | |
| 3,865,185 | 2/1975 | Ostbo | 165/165 |
| 4,096,910 | 6/1978 | Coffinberry et al. | 165/165 |
| 4,291,760 | 9/1981 | Argyle et al. | 165/51 |
| 4,431,050 | 2/1984 | Martin | 165/166 |
| 4,624,305 | 11/1986 | Rojey | 165/165 |
| 4,742,866 | 5/1988 | Yamanaka et al. | 165/38 |
| 4,836,276 | 6/1989 | Yamanaka et al. | 165/51 |
| 4,880,055 | 11/1989 | Niggemann et al. | 165/167 |
| 4,934,454 | 6/1990 | Vandyke etal. | 165/165 |
| 5,014,775 | 5/1991 | Watanabe . | |
| 5,078,209 | 1/1992 | Kerkman et al. . | |
| 5,099,912 | 3/1992 | Tajima et al. | 165/167 |
| 5,099,915 | 3/1992 | VanDyke | 165/156 |

FOREIGN PATENT DOCUMENTS

| | | | |
|---|---|---|---|
| 0077656 | 4/1983 | European Pat. Off. . | |
| 0208957 | 1/1987 | European Pat. Off. . | |
| 2152729 | 4/1973 | France . | |
| 2759785 | 4/1985 | Germany . | |
| 4125222 | 2/1992 | Germany . | |
| 60-101488 | 6/1985 | Japan . | |
| 60-99990 | 6/1985 | Japan . | |
| 4-353392 | 12/1992 | Japan . | |
| 4-356686 | 12/1992 | Japan . | |
| 604464 | 7/1948 | United Kingdom | 165/166 |
| 2162630 | 2/1986 | United Kingdom . | |

*Primary Examiner*—John K. Ford

*Attorney, Agent, or Firm*—Cushman Darby & Cushman Intellectual Property Group of Pillsbury Madison & Sutro, LLP

[57] ABSTRACT

First and second communicating holes are formed in a first formed plate 11, and first and second communicating holes are also formed in a second formed plate 12. The first and second formed plates 11 and 12 are joined to each other to form a joined body 8. When a plurality of joined bodies 8 are stacked, a heat exchanging section 7 is formed that is provided with a plurality of flow pipes 34 in which the first communicating holes are connected with each other in the stacking direction and the second communicating holes are also connected with each other. In the plurality of flow pipes 34 of the heat exchanging section 7, oil passage 35 in which engine oil flows in the stacking direction is formed, and further around the plurality of flow pipes 34, a plurality of cooling water passages 36 in which engine cooling water flows are formed.

13 Claims, 41 Drawing Sheets

HEAT EXCHANGER

BACKGROUND OF THE INVENTION

1. Field of the Invention

The present invention relates to a heat exchanger used, for example, in an oil cooler utilizing engine cooling water to cool engine lubrication oil.

2. Description of Related Art

The inventors have proposed an oil cooler provided with a heat exchanging section 100 shown in FIG. 46 disclosed in Japanese Unexamined Patent Publication (Kokai) No. Hei 3-128094 (date of filing: May 31, 1991) and Japanese Unexamined Patent Publication (Kokai) No. 3-129447 (date of filing: May 31, 1991).

A plurality of flow passages 105 in which engine oil flows are formed in a heat exchanging section 100 when a plurality of joined bodies 103 of the same configuration are stacked, in which a fin plate 102 is provided between a pair of formed plates 101. Also, a plurality of cooling water passages 106 in which cooling water flows are formed between adjoining joined bodies 103 around the plurality of flow pipes 105.

Expanding portions 107 are formed on the inner circumferential side so as to expand on one side by press forming on the edge surface of the inner peripheral side of the formed plate 101. A plurality of communicating holes 108 are provided in the expanding portions 107. Four expanding portions 107 are successively formed on the outer circumference of the expanding portion 107 on the inner circumferential side to the edge surface on the outer peripheral side of the formed plate 101. In each expanding portion 107, the communicating hole 108 is formed. The expanding portions 107 are connected with each other through the communicating holes 108 in the stacking direction.

However, the following problems are caused. In the aforementioned heat exchanging section 100, a bent portion is necessarily formed in the expanding portion 107 in the process of press forming. Therefore, the number of the flow passages 105 formed in the same volume is limited, so that the radiating area is reduced.

Since a portion to be used for a brazing space is projected into the communicating hole 108, the dimensions of the communicating hole 108 are reduced. The oil flow is therefore interrupted. Therefore, the speed of oil flow is lowered in a position close to the wall surface of the expanding portion 107. Accordingly, the heat exchanging efficiency between engine oil and cooling water is deteriorated.

SUMMARY OF THE INVENTION

It is a primary object of the present invention to provide a heat exchanger in which the radiating area is increased so as to improve the heat exchanging efficiency, even if a larger number of flow passages are formed with the same volume.

According to an aspect of the present invention, a heat exchanger is provided comprising a plurality of flat plates, a plurality of first communicating holes penetrating through the flat plates in the thickness direction, a plurality of second communicating holes penetrating through the flat plates in the same direction as that of the first communicating holes, the second communicating holes adjoining the first communicating holes through plate wall portions of the flat plates, the plurality of flat plates being stacked so that the first communicating holes communicate with each other in the stacking direction and also the second communicating holes communicate with each other in the stacking direction, wherein a plurality of flow pipes in which a first heating medium flows are formed by the stacked plate wall portions being extended in the stacking direction, and a plurality of flow passages in which a second heating medium flows are formed around the flow pipes so that heat is exchanged between the first and the second heating mediums through the flow passages.

In this invention, when a plurality of flat plates are stacked in which a plurality of first communication holes and a plurality of second communication holes are adjacent to each other through a wall portion, a plurality of flow pipes in which the first heating medium flows are formed, and further flow passages in which the second heating medium flows are formed around the flow pipes.

Therefore, a bent portion is not formed on the flat plate, so that it is possible to provide a larger number of flow pipes in the same volume. As a result, the heat exchanging area is increased. Further, no structure is provided to block the flow of the first heating medium in the extending direction of the flow pipe. Accordingly, the flow velocity in a position close to the wall surface is increased. Therefore, the heat exchanging efficiency between the first and second mediums can be improved.

According to another aspect of the present invention, a heat exchanger is provided comprising a pair of flat plates in which one first communicating hole penetrates through an island-shaped portion connected with the inner circumferential side of an annular external frame portion through a connection member, and in which two second communicating holes penetrate in the same direction as that of the first communicating hole so that the second communicating holes are separated by the connection member and the second communicating holes are formed surrounding the island-shaped portion, the flat plates being stacked so that the first communicating holes communicate with each other and also the second communicating holes communicate with each other, one flow pipe provided with a first heating medium passage in which a first heating medium flows being formed by stacked island-shaped portions so that it extends in the stacking direction, a first heating medium passage being formed in which a second heating medium flows to exchange heat with the first heating medium through the flow pipe as if the second heating medium flows around each connection member and island-shaped portion.

In this invention, when a pair of flat plates are stacked in which the first communicating hole, of which there is one, and the second communicating holes, of which there are two, are joined to each other through the connection member and the island-shaped portion, one flow pipe having the first heating medium passage is formed in which the first heating medium flows, and further the second heating medium passage is formed in which the second heating medium flows as if the heating medium flows around the connecting members and the island-shaped portions.

Therefore, the flow of the first heating medium in the extending direction of the flow pipe unimpeded. Accordingly, the flow velocity in a position close to the wall surface is increased. Therefore, the heat exchanging efficiency between the first and second mediums can be improved.

BRIEF DESCRIPTION OF THE DRAWINGS

FIGS. 1 to 10 show the first embodiment a heat exchanger of the present invention, wherein FIG. 1 is a sectional view showing an oil cooler, FIG. 2 is a sectional view showing a primary portion of the heat exchanger, FIG. 3 is an exploded view showing a joined body, FIG. 4 is a plan view showing the first formed plate, FIG. 5 is a plan view showing the second formed plate, FIG. 6 is a plan view showing a fin plate, FIG. 7 is a plan view showing an upper end plate, FIG. 8 is a plan view showing a lower end plate, FIG. 9 is a schematic illustration showing the flow directions of engine oil and cooling water, and FIG. 10 is a perspective view showing the flow directions of engine oil and cooling water in a heat exchanging section;

FIGS. 15 to 18 show the fourth embodiments, wherein

FIG. 15 is a sectional view showing an oil cooler,

FIG. 16 is a plan view showing the first formed plate,

FIG. 17 is a plan view showing the second formed plate, and

FIG. 18 is a plan view showing a fin plate;

FIGS. 26 to 29 show the eighth embodiment, wherein

FIG. 26 is a sectional view showing a primary portion of the heat exchanger,

FIG. 27 is an exploded view showing a joined body,

FIG. 28 is a plan view showing the first formed plate, and

FIG. 29 is a plan view showing the second formed plate;

FIGS. 30 to 34 show the ninth embodiment, wherein

FIG. 30 is an exploded view showing a heat exchanger,

FIG. 31 is a perspective view showing a heat exchanger,

FIG. 32 is a plan view showing a heat exchanger,

FIG. 33 is a sectional view taken on line 33—33 in FIG. 32, and

FIG. 34 is a sectional view taken on line A–B–C–D–E–A in FIG. 32;

FIGS. 36 to 43 show the eleventh embodiment, wherein

FIG. 36 is a sectional view showing the oil cooler,

FIG. 37 is a plan view showing the lower end bracket,

FIG. 38 is a sectional view taken on line 38—38 in FIG. 37,

FIG. 39 is a plan view showing the first formed plate,

FIG. 40 is a plan view showing the second formed plate,

FIG. 41 is a plan view showing the fin plate, and FIGS. 42 and 43 are sectional views showing the relief valve;

DETAILED DESCRIPTION OF THE DRAWINGS

Figure 1:
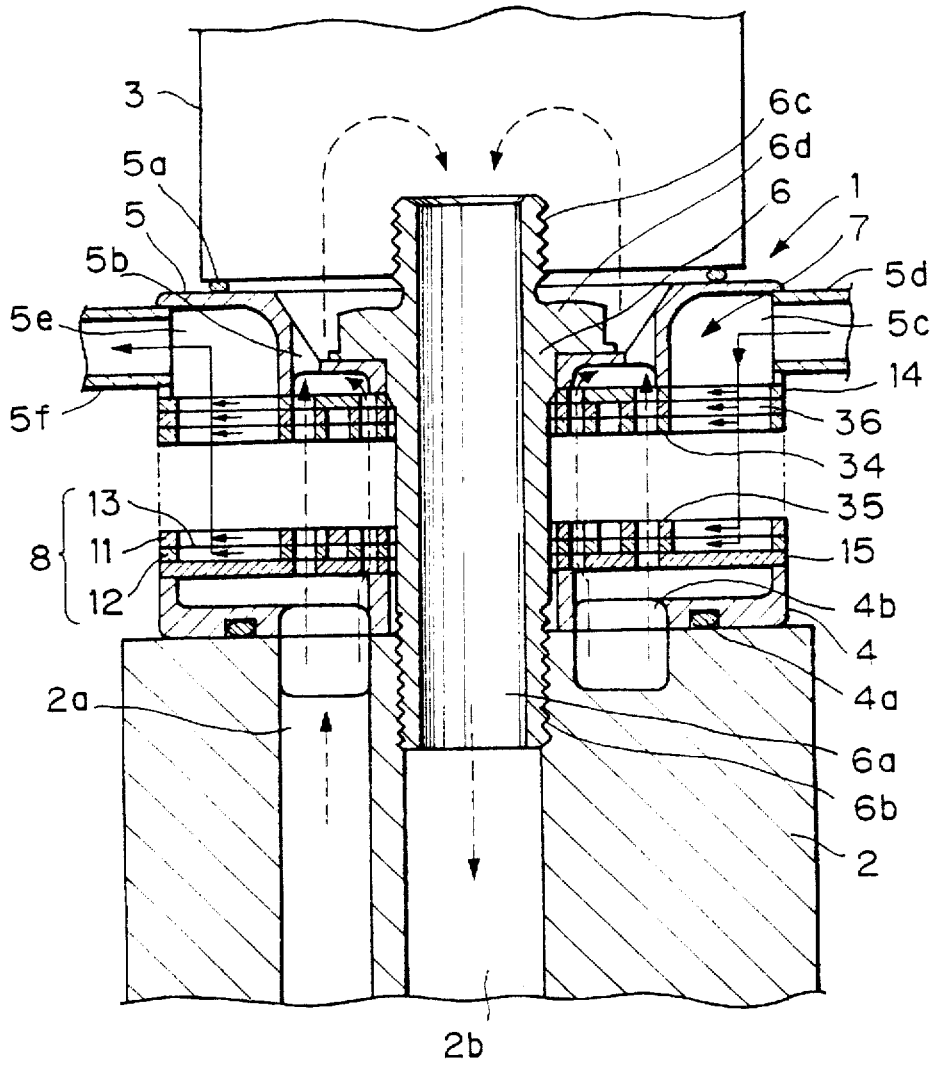

With reference to the embodiments shown in the drawings, a heat exchanger of the present invention will now be explained in detail as follows.

The first embodiment of the present invention is shown in FIGS. 1 to 10. FIG. 1 is a view showing an oil cooler.

The oil cooler 1 is provided between an engine 2 for driving a vehicle and an oil filter 3. This oil cooler 1 includes a lower side bracket 4 mounted on the engine 2, an upper side bracket 5 on which the oil filter 3 is mounted, a cylindrical union 6 to return the engine oil from the oil filter 3 to the engine 2, and a heat exchanging section 7 for cooling the engine oil by engine cooling water, wherein the heat exchanging section 7 is provided between the lower and upper side brackets 4 and 5.

The engine 2 includes: an outflow passage 2*a* that guides the engine oil for lubricating each mechanical portion (not shown) into the oil filter 3 through the oil cooler 1; and an inflow passage 2*b* that guides the engine oil filtered by the oil filter 3 through the union 6.

The oil filter 3 filters the engine oil and has a structure known in the prior art.

The lower end bracket 4 is made of a metal such as an aluminum alloy, and is formed into an annular plate shape. An O-ring 4*a* to prevent the leakage of engine oil is provided between the lower end bracket 4 and the engine 2. This lower side bracket 4 is provided with a plurality of inlet openings 4*b* that communicate the outflow passage 2*a* of the engine 2 with the heat exchanging section 7. The lower end bracket 4 is joined with the lower end of the heat exchanging section 7 by means of brazing or the like.

The upper end bracket 5 is made of a metal such as an aluminum alloy, and formed into an annular plate shape. An O-ring 5*a* to prevent the leakage of engine oil from a gap between the upper end bracket 5 and the oil filter 3 is provided between the upper end bracket 5 and the oil filter 3. A plurality of outlet openings 5*b* communicating the inside of the oil filter 3 and that of the heat exchanging section 7 are formed in the upper end bracket 5. The upper end bracket 5 is connected with the upper end of the heat exchanging section 7 by means of brazing or the like.

The outer circumferential wall on the right side of the upper end bracket 5 is connected with an inlet pipe 5*d* to introduce the engine cooling water to the heat exchanging section 7 through a cooling water passage 5*c* from a cooling water pipe (not shown). The outer circumferential wall on the left side of the upper end bracket 5 is connected with an outlet pipe 5*f* that returns the engine cooling water from the heat exchanging section 7 to a cooling water pipe (not shown) through a cooling water passage 5*e*.

In the union 6, a communicating passage 6*a* is formed to communicate the inside of the oil filter 3 with the inflow passage 2*b*. A male screw 6*b* to engage with the engine 2 is provided on the outer circumference of the union 6 on the engine 2 side, and a male screw 6*c* to engage with the oil filter 3 is provided on the outer circumference of the union 6 on the oil filter 3 side, and also the union 6 is provided with a hexagonal section 6*d* that comes into contact with the upper end bracket 5. When torque is applied to this hexagonal portion 6d by a tool such as a spanner, the male screw 6b is engaged with the engine 2, and the oil cooler 1 is mounted on the engine 2 by the force from the hexagonal portion 6d that pushes the oil cooler 1 to the engine 2.

Figure 2:
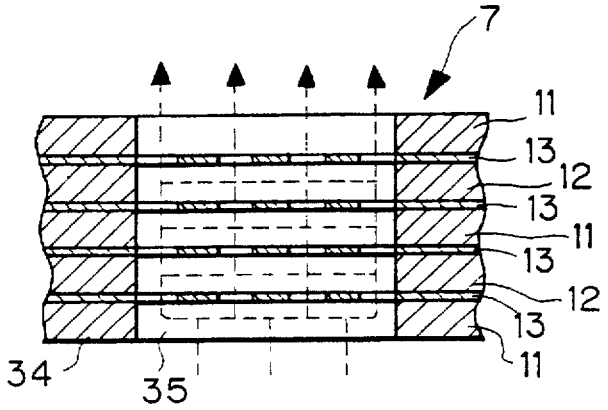

FIG. 2 is a view showing a primary portion of the heat exchanging section. The heat exchanging section 7 is composed of a plurality of joined bodies 8 (shown in FIG. 3) that are provided around the outer circumference of the union 6 in the thickness direction of the joined bodies 8, wherein the joined body 8 includes a first formed plate 11, a second formed plate 12, the configuration of which is different from that of the first formed plate 11, and a fin plate 13 provided between the first and the second formed plates 11 and 12, wherein the configuration of the fin plate 13 is different from that of the first and the second formed plates 11 and 12.

In the upper end portion of the joined body 8, an upper end plate 14, the configuration of which is different from that of the first and the second formed plates 11 and 12, is provided, and in the lower end portion of the joined body 8, a lower end plate 15, the configuration of which is different from that of the upper end plate 14, is provided.

Figure 4:
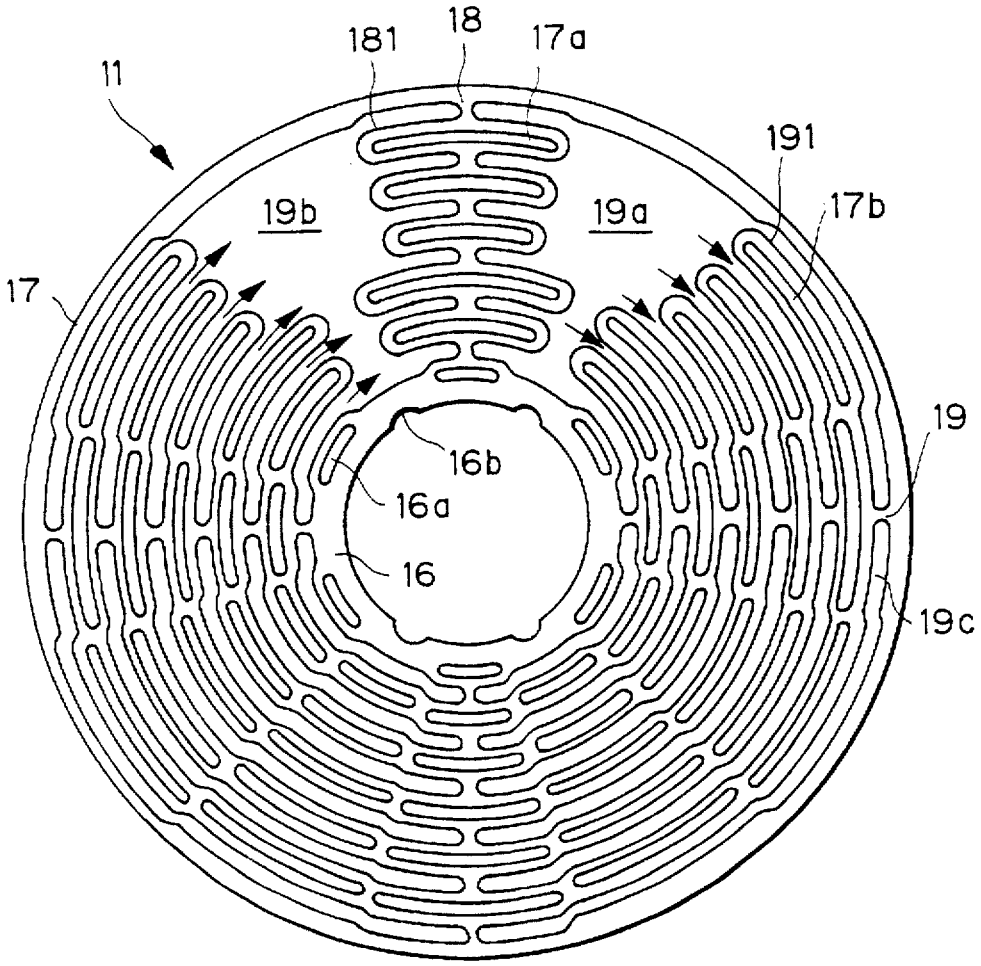

FIG. 4 is a view showing the first formed plate. The first formed plate 11 is a flat plate in the present invention. For example, the first formed plated 11 is made of a metal such as an aluminum alloy. For example, it is formed into an approximately annular plate shape by means of press punching. For example, the thickness of this first formed plate 11 is 0.8 mm, and an annular inner frame 16 forming an inner circumferential wall of the heat exchanging section 7 is provided on the edge surface on the inner peripheral side, and an annular outer frame 17 forming an outer circumferential wall of the heat exchanging section 7 is provided on the edge surface on the outer peripheral side.

The annular inner frame 16 is provided with six first communicating holes 16a penetrating through the inner frame 16 in the thickness direction, wherein the first communicating holes 16a are on the same circumference. The first communicating holes 16a are composed of six holes, and the communicating holes are approximately formed arcuate and flat, and engine oil flows in the communicating holes. On the inner circumference of the inner frame 16, four positioning grooves 16b are provided that are engaged with an assembly jig 37 (FIG. 3) when the heat exchanging section 7 is assembled.

Five rows of flat arc portions 181 are successively formed toward the outer frame 17 on the outer circumferential side of the first communicating hole 16a on the upper side in FIG. 4. In the arcuate portion 181 of each row, the first communicating hole 17a is formed in such a manner that it penetrates through the arcuate portion 181 in the thickness direction.

Each first communicating hole 17a is formed approximately arcuate and flat, and engine oil flows inside the first communicating hole 17a. The arcuate portions 181 of the respective rows are connected with each other by the first connection member 18 in the radial direction and are also connected to the inner frame portion 16 and the outer frame portion 17, respectively.

Between the inner and outer frames 16 and 17 except for a plurality of first arc portions 181, five rows of second arc portions 191 connected by the three first connection member 19 are successively formed from the inner frame portion 16 to the outer frame portion 17. A plurality of approximately arcuate and flat first communicating holes 17b are formed in the arc portion 191 of each row in such a manner that the first communicating holes 17b penetrate through the arc portion 191 in the thickness direction. In this case, each first communicating hole 17b is radially disposed from the inner frame portion 16 to the outer frame portion 17. The first communicating hole 17b of each row is composed of the first communicating hole 17a, the first hole group that is opened on the same circumference, and the second hole group that is opened slightly on the inner circumferential side as compared with the first hole group.

Second communicating holes 19a and 19b in which engine cooling water flows are formed in a portion that is an upper half of the first formed plate 11 and divided by the first connecting members 18, 19 and that surrounds the arc portion 181.

In a portion that is a lower half of the first formed plate 11 and divided by the adjoining first connecting member 19 and that surrounds the arc portion 191, six rows of the second arcuate communicating holes 19c in which engine cooling water flows are provided at two positions so that they can be disposed on the same circumference.

In the first formed plate 11, the wall portion of the present invention includes the inner frame portion 16, outer frame portion 17, first connection members 18, 19, and arc portions 181, 191.

Figure 5:
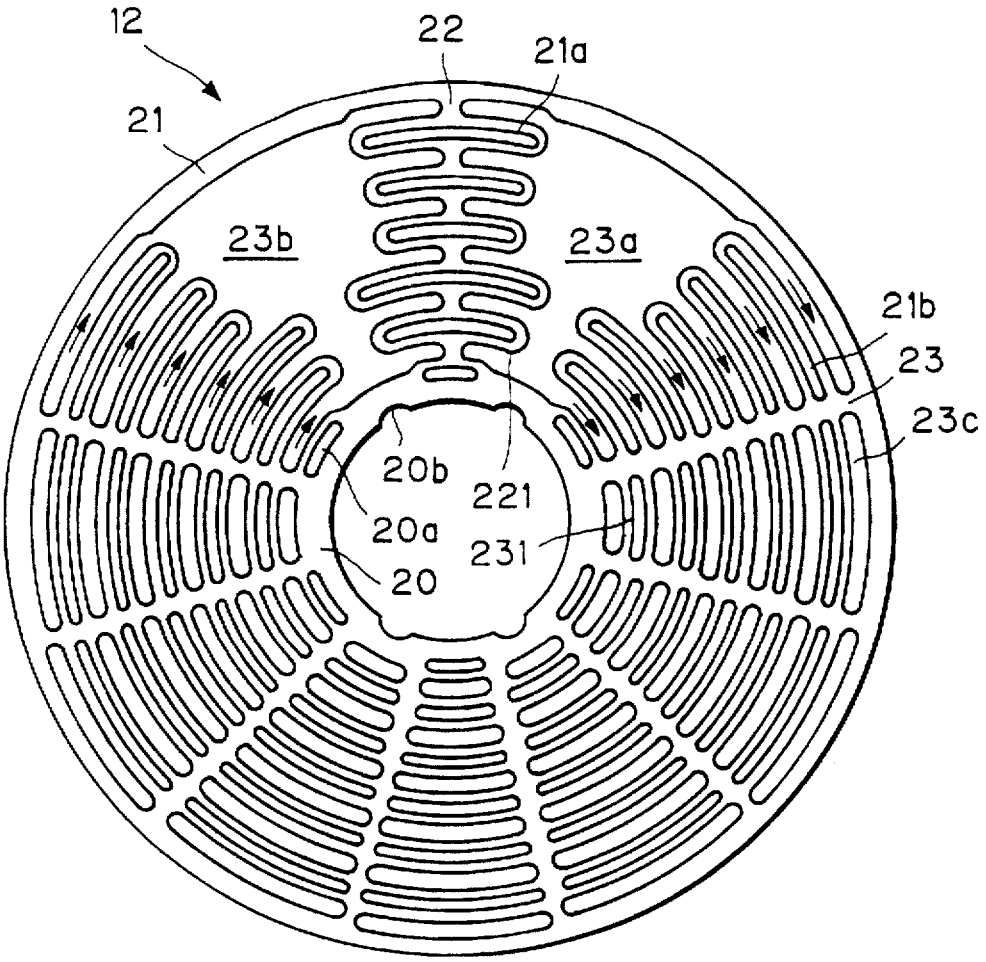

FIG. 5 is a view showing the second formed plate. The second formed plate 12 is a flat plate in the present invention, and for example, the second formed plate 12 is made of a metal such as an aluminum alloy. For example, the second formed plate 12 is formed into an approximately annular plate shape by means of press punching. For example, the thickness of the second formed plate 12 is 0.8 mm, and the second formed plate 12 is provided with an inner frame portion 20 composing the inner circumferential wall of the heat exchanger 7 in a position corresponding to the inner frame 16 of the first formed plate 11. An outer frame portion 21 composing the outer circumferential wall of the heat exchanger 7 is provided on the outer circumferential side of the second formed plate 12.

The first arcuate communicating holes 20a penetrating through the inner frame portion 20 are provided in the inner frame portion 20 in such a manner that they are disposed on the same circumference. These first communicating holes 20a are composed of six holes and are opened in a position corresponding to each first communicating hole 16a formed in the first formed plate 11, and further each first communicating hole 20a is respectively communicated with each first communicating hole 16a. On the inner circumference of the inner frame portion 20, four grooves 20b for positioning are provided that are engaged with an assembly jig 37 (FIG. 3) when the heat exchanging section 7 is assembled.

Five rows of flat arc portions 221 are successively formed toward the outer frame 21 on the outer circumferential side of the first communicating hole 20a on the upper side in FIG. 5. In the arcuate portion 221 of each row, the approximately arcuate and flat first communicating hole 21a is formed in such a manner that it penetrates through the arcuate portion 221 in the thickness direction. Each of these first communicating holes 21a is open in a position corresponding to each of the first communicating holes 17a, so that the first communicating holes 21a respectively communicate with the first communicating holes 17a. The arc portion 221 of each row is respectively connected with the second connection member 22 in the radial direction, and at the same time connected with the inner and outer frame portions 20 and 21.

Each of the first communicating holes 21a is respectively formed into an approximately arcuate and flat shape, and engine oil flows in the first communicating holes 21a.

Between the inner frame portion 20 and the outer frame portion 21 except for the arc portion 221, five rows of arc portions 231 connected by the eight second connecting members 23 are successively provided from the inner frame portion 20 to the outer frame portion 21. In the arc portion 231 of each row, a plurality of approximately arcuate and flat first communicating holes **21*b* are provided in such a manner that they penetrate through the arc portion 231 in the thickness direction. The first communicating holes 21*b* are composed of the first hole group opened on the same circumference as that of the first communicating holes 21*a***, and also composed of the second hole group opened slightly on the inner circumferential side compared with the first hole group.

The first communicating holes **21*b* are respectively formed approximately arcuate and flat. Each first communicating hole 21*b* is open in a position corresponding to each first communicating hole 17*b* and communicating with each first communicating hole 17*b***.

In an upper half portion of the second formed plate 12 that is divided by the second connection members 22, 23 and surrounds five rows of arc portions 221, the second communicating holes **23*a*, 23*b* respectively communicating with the second communicating holes 19*a*, 19*b*** are provided.

In a lower half portion of the second formed plate 12 that is divided by the adjoining second connection member 23 and surrounds the arc portion 231, a plurality of arcuate second communicating holes **23*c* respectively communicating with the second communicating holes 19*a*, 19*b*, 19*c*** are provided.

In the second formed plate 12, the wall portion of the present invention is composed of the inner frame portion 20, outer frame portion 21, second connection members 22, 23, and arc portions 221, 231.

Figure 6:
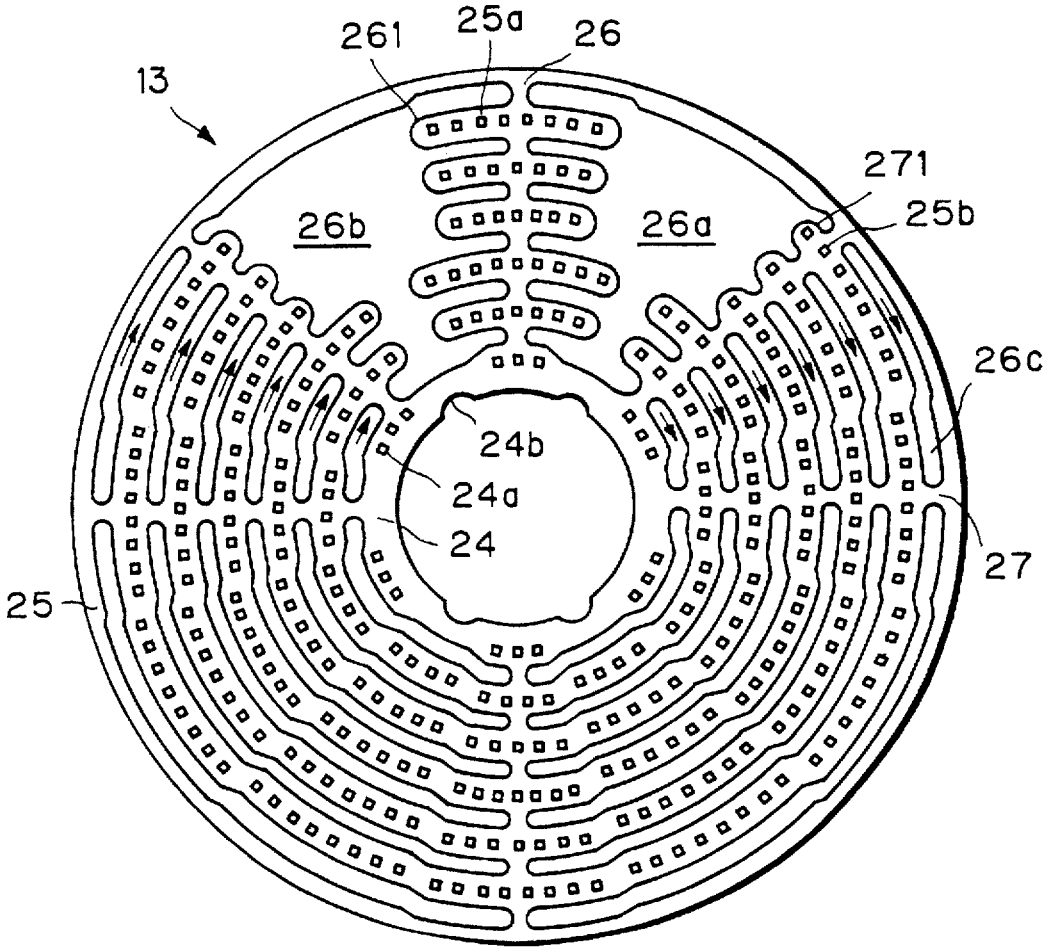

FIG. 6 is a view showing a fin plate. The fin plate 13 is a flat plate in the present invention. The fin plate 13 composes an inner fin that improves the heat transmission efficiency of engine oil so that the heat exchanging efficiency between the engine oil and engine can be improved. This fin plate 13 is made of a metal such as an aluminum alloy and is formed into an approximately annular plate by means of press punching.

For example, the thickness of the fin plate 13 is 0.1 mm, and the fin plate 13 is provided with an inner frame portion 24 composing the inner circumferential wall of the heat exchanging section 7, wherein the inner frame portion 24 is located in a position corresponding to the inner frame portions 16, 20. The fin plate 13 is also provided with an outer frame portion 25 composing the outer circumferential wall of the heat exchanging section 7, wherein the outer frame portion 25 is located in a position corresponding to the outer frame portion 17.

In the inner frame portion 24, the arcuate first communicating apertures **24*a* penetrating the inner frame portion 24 in the thickness direction are provided on the same circumference. Each of the first communicating apertures 24*a* includes six opening portions, and the first communicating apertures 24*a* respectively communicate with the first communicating holes 16*a*, 20*a*. On the inner circumference of the inner frame portion 24, four grooves 24*b* for positioning are provided that are engaged with the assembly jig 37 when the heat exchanging section 7** is assembled.

An arc portion 261 is provided on the fin plate 13 in a position corresponding to the arc portion 181. In the arc portion 261, the first communicating apertures **25*a* are provided on the same circumference. The first communicating apertures 25*a* are a plurality of openings. They are open in a position corresponding to the first communicating holes 17*a*, 21*a* so that they are respectively communicated with the first communicating holes 17*a*, 21*a*. The arc portions 261 are connected by the connection members 26 in the radial direction and also connected with the inner and outer frame portions 24 and 25**.

Between the inner frame portion 24 and the outer frame portion 25 except for the arc portion 261, the arc portions 271 connected by five rows of connection members 27 are successively provided from the inner frame portion 24 to the outer frame portion 25. In the arc portion 271 of each row, a plurality of approximately arcuate and flat first communicating apertures **25*b* are provided in such a manner that they penetrate through the arc portion 271 in the thickness direction. The first communicating apertures 25*b* bare open in positions corresponding to the first communicating holes 17*b*, 21*b*, and communicated with the first communicating holes 17*b*, 21*b*. The first communicating apertures 25*b* include the first hole group that are open on the same circumference as that of the first communicating apertures 25*a***, and the second hole group that are open slightly on the inner circumferential side compared with the first hole group.

In the upper half portion of the fin plate 13 that is divided by the connection members 26, 27 and surrounds the arc portion 261, the second communicating openings **26*a*, 26*b* are provided in the thickness direction of the fin plate 13. These second communicating openings 26*a*, 26*b* respectively communicate with the second communicating holes 19*a*, 19*b*, 23*a*, 23*b***.

In the lower half portion of the fin plate 13 that is divided by the two connection members 26, 27 around the arc portion 271, the arcuate second communicating openings **26*c* are provided on the same circumference in the thickness direction of the fin plate 13. These arcuate second communicating openings 26*c* respectively communicate with the second communicating holes 19*a* to 19*c*, and 23*a* to 23*c***.

In the fin plate 13, the wall portion of the present invention is composed of the inner frame 24, outer frame 25, connection members 26, 27, and arc portions 261, 271.

Figure 7:
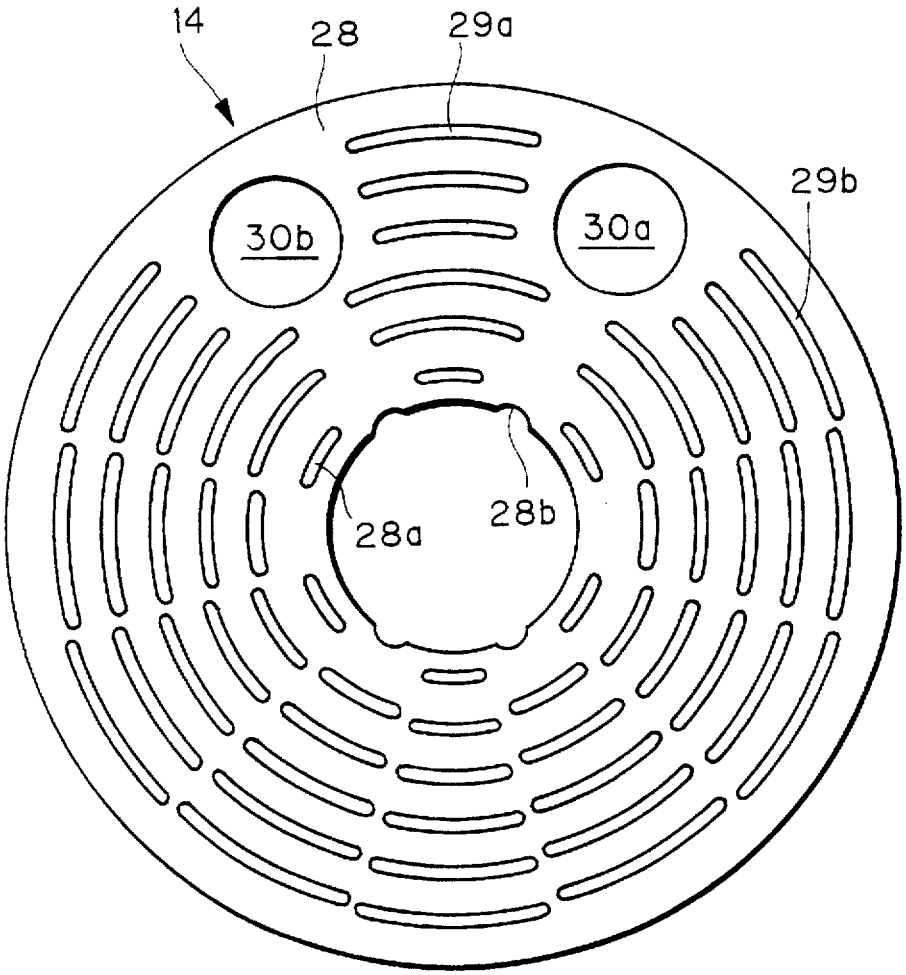

As shown in FIG. 7, the upper end plate 14 is made of a metal such as an aluminum alloy, and for example, it is formed by means of press punching. The upper end plate 14 is provided with an annular plate portion 28, the inner circumferential surface of which composes the inner circumferential wall of the heat exchanging section 7, the outer circumferential surface of which composes the outer circumferential wall of the heat exchanging section 7. In this annular plate portion 28, six arcuate first communicating holes **28*a* are provided on the same circumference in the positions corresponding to the first communicating holes 16*a*, 20*a* and the first communicating apertures 24*a*, and four grooves 28*b* for positioning are formed on the inner circumference. These first communicating holes 28*a* respectively communicate with the first communicating holes 16*a*, 20*a* and the first communicating apertures 24*a***.

In the annular plate portion 28, the first communicating holes **29*a*, 29*b* are provided on a circumference, wherein the first communicating holes 29*a*, 29*b* are open in the positions corresponding to the first communicating holes 17*a*, 17*b*, 21*a*, 21*b* and the first communicating apertures 25*a*, 25*b*, and further the first communicating holes 29*a*, 29*b* are respectively communicated with the first communicating holes 17*a*, 17*b*, 21*a*, 21*b* and the first communicating apertures 25*a*, 25*b***. Further, the first communicating holes 29a, 29b communicate with the outlet opening 5b of the upper end bracket 5. Therefore, the first communicating holes 29a, 29b form the outflow ports through which engine oil flows out.

Further, in the annular plate portion 28, circular communicating ports 30a, 30b are provided that are respectively communicated with the second communicating holes 19a, 23a, 19b, 23b. The communicating ports 30a, 30b are respectively communicated with the cooling water passages 5c, 5e of the upper bracket 5. Therefore, the communicating port 30a forms an inflow port through which engine cooling water flows into the heat exchanging section 7, and the communicating port 30b forms an outflow port through which engine cooling water flows out from the heat exchanging section 7.

The annular plate portion 28 is formed so that it closes the positions corresponding to the second communicating holes 19c, 23c and the second communicating opening 26c.

Figure 8:
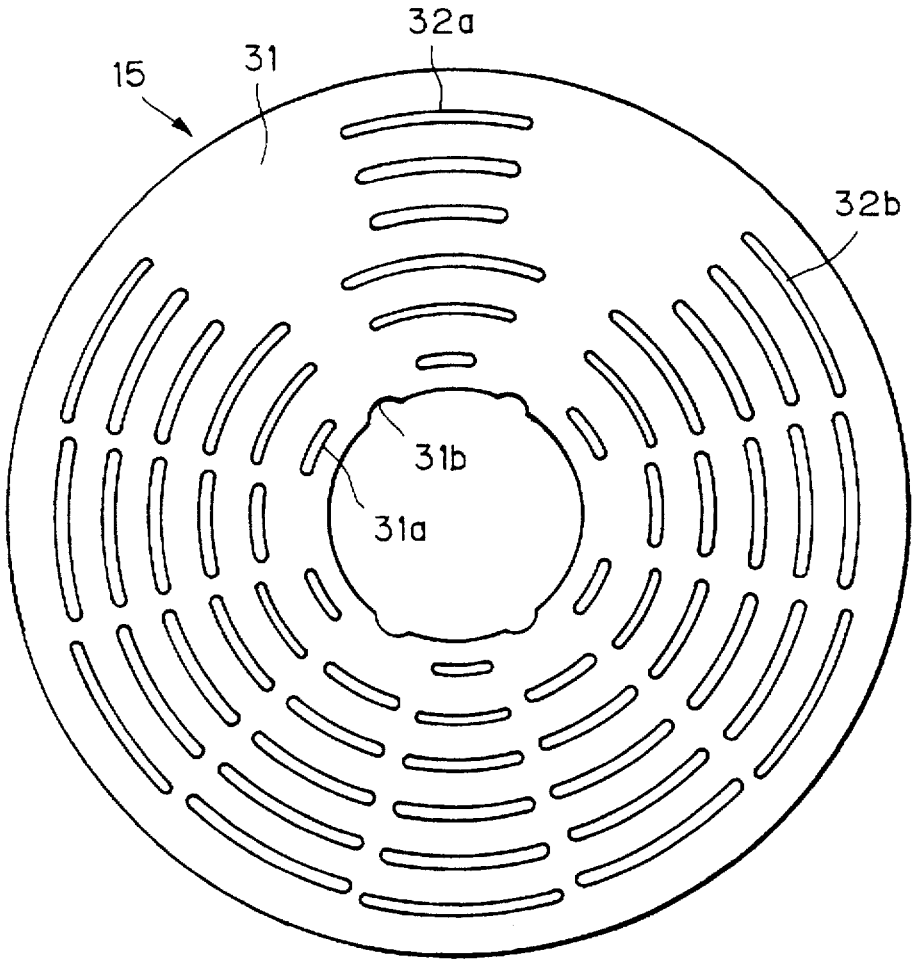

As shown in FIG. 8, the lower end plate 15 is made of a metal such as an aluminum alloy, and for example, it is formed by means of press punching. The lower plate 15 is provided with an annular plate portion 31, the inner circumferential surface of which forms an inner circumferential wall of the heat exchanging section 7, the outer circumferential surface of which forms an outer circumferential wall of the heat exchanging section 7. In this annular plate portion 31, six arcuate first communicating holes 31a are provided on the same circumference in the positions corresponding to the first communicating holes 16a, 20a, 28a and the first communicating aperture 24a. On the inner circumference, four grooves 31b for positioning are provided. These first communicating holes 31a respectively communicate with the first communicating holes 16a, 20a, 28a and the first communicating apertures 24a.

In the annular plate portion 31, first communicating holes 32a, 32b are formed on a circumference, wherein the first communicating holes 32a, 32b are respectively open in the positions corresponding to the first communicating holes 17a, 17b, 21a, 21b, 29a, 29b and the first communicating apertures 25a, 25b, and the first communicating holes 32a, 32b respectively communicate with the first communicating holes 17a, 17b, 21a, 21b, 29a, 29b and the first communicating apertures 25a, 25b. The first communicating holes 32a, 32b also communicate with the inflow opening 4b of the lower end bracket 4. Therefore, the first communicating holes 32a, 32b form an inflow port through which engine oil flows into the heat exchanging section 7.

The annular plate portion 31 is formed so that it closes the positions corresponding to the second communicating holes 19a to 19c and 23a to 23c, and also closes the positions corresponding to the second communicating openings 26a to 26c.

As shown in FIG. 2, in the heat exchanging section 7, when a plurality of joined bodies 8 are stacked around the outer circumference of the union 6, a plurality of arcuate flow pipes 34, the section of which is flat, extending in the thickness direction, are formed approximately radially. In the flow pipes 34, a plurality of oil passages 35 are formed through which engine oil flows from the lower end plate 15 to the upper end plate 14. The plurality of oil passages 35 are formed when the first communicating holes 17a, 17b, 21a, 21b, 29a, 29b, 32a, 32b and the first communicating apertures 25a, 25b respectively communicate.

Figure 9:
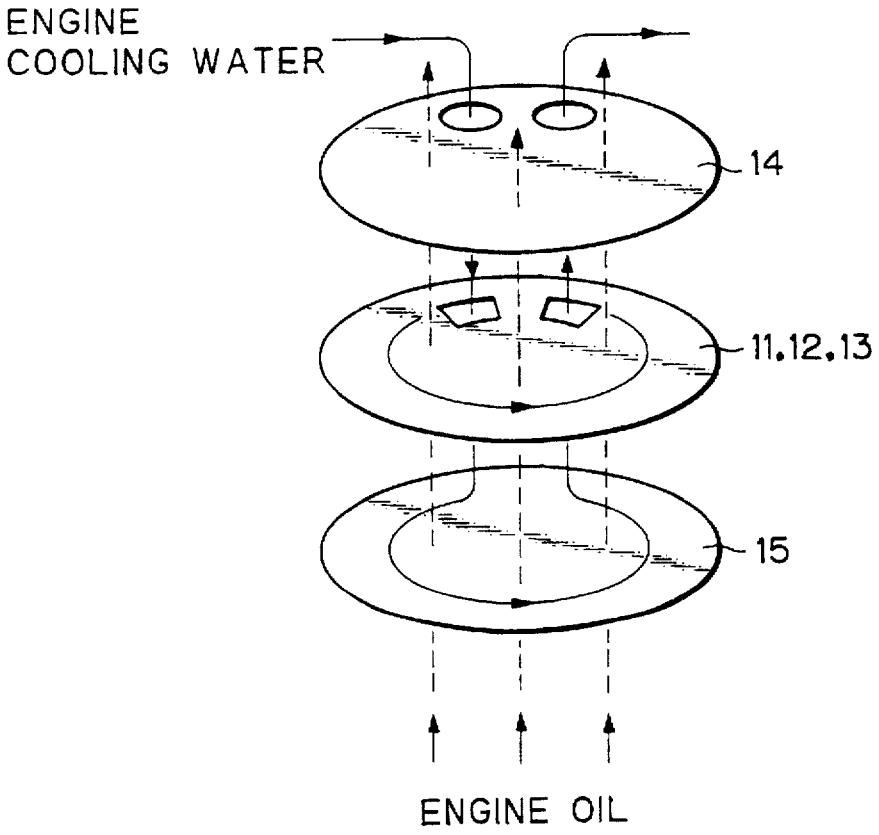
Figure 10:
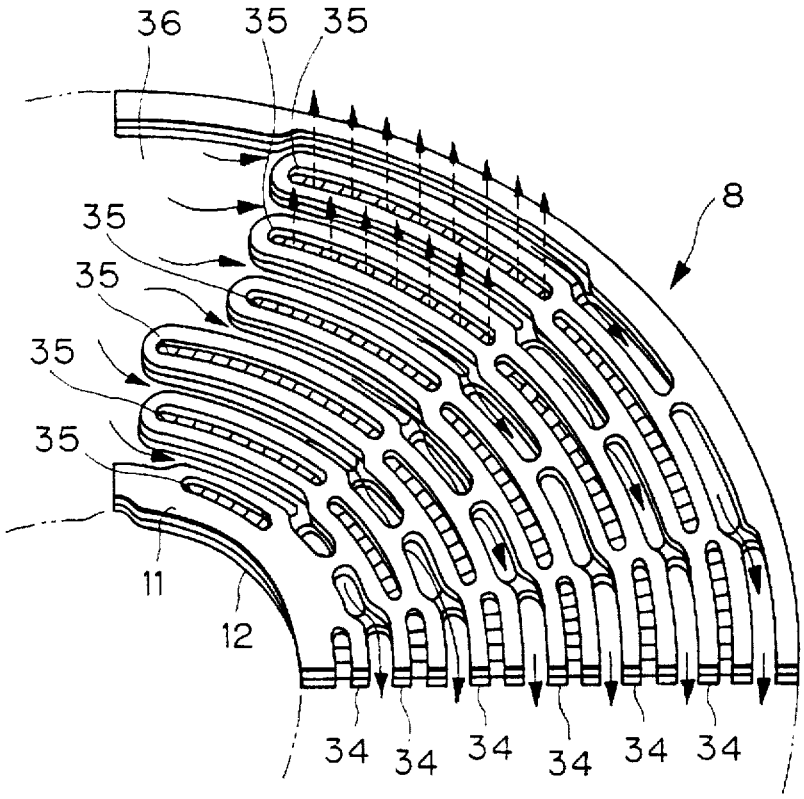

As shown by a broken line arrow in FIGS. 9 and 10, engine oil linearly flows in the plurality of flow pipes 34.

A plurality of cooling water passages 36 in which engine cooling water flows are provided between the adjoining joined bodies 8 and around the plurality of flow pipes 34. These cooling water passages 35 are the passages of the present invention, and they are formed when the second communicating holes 19a to 19c and 23a to 23c and the second communicating openings 26a to 26c respectively communicate. As shown by a solid line arrow in FIGS. 9 and 10, engine cooling water flows around the flow pipes 34 in each joined body 8 as if it sewed around the flow pipes 34.

Engine cooling water flows in the cooling water passages 36 formed around the plurality of flow pipes 34 in the surface direction of the joined body 8, and the heat exchange is conducted between the engine oil flowing in the oil passages 35 and the engine cooling water flowing in the cooling water passage 36, so that the engine oil can be cooled.

Figure 3:
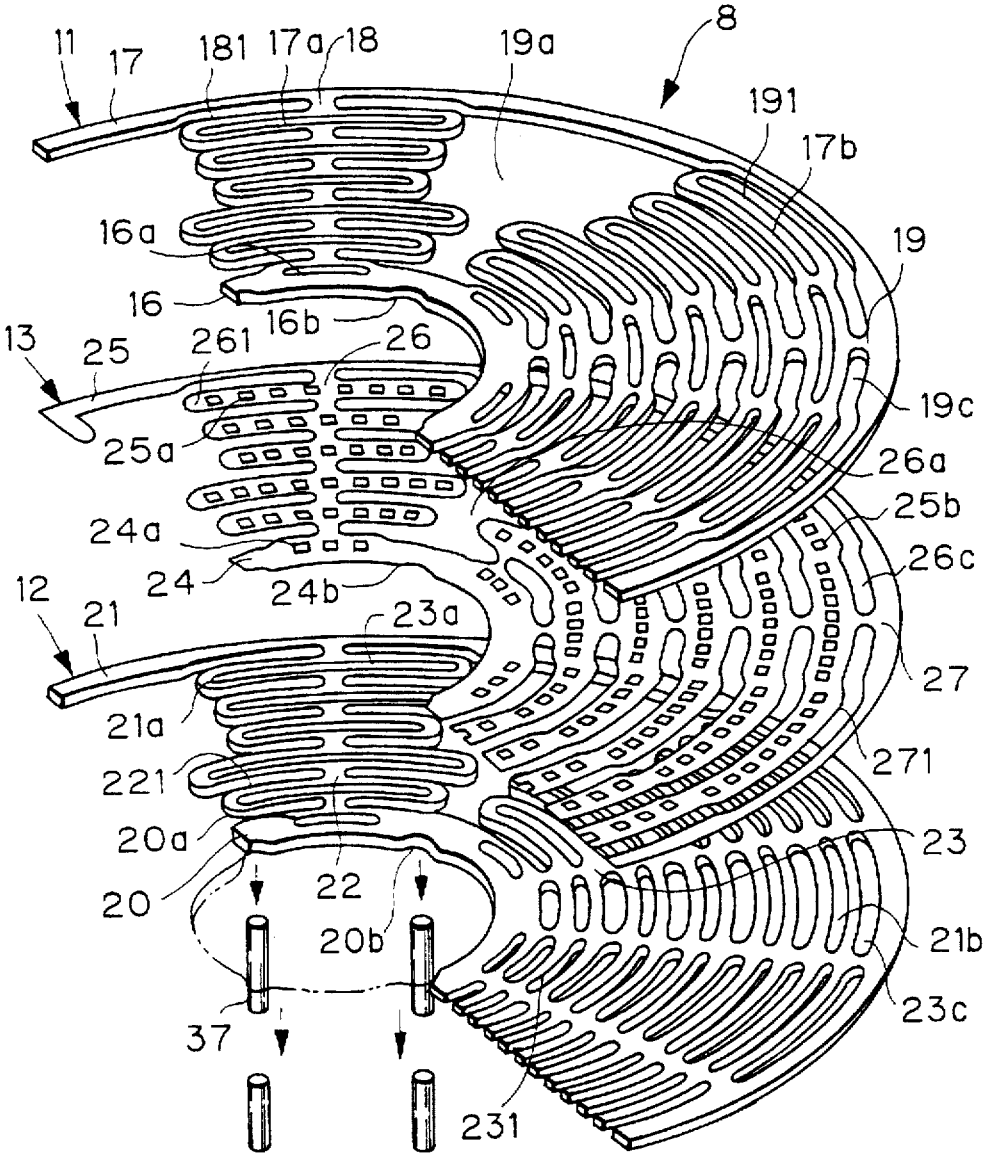

With reference to FIGS. 1 to 3, the assembling method of the heat exchanging section 7 of the oil cooler 1 will now be explained as follows.

First, while the four grooves 16b formed on the inner circumference of the first formed plate 11 are in contact with four assembly jigs 37, the first formed plate 11 is engaged with the outside of the four assembly jigs 37.

In the same manner, while the grooves 20b, 24b, 28b, 31b are in contact with the four assembly jigs 37, the second formed plate 12, fin plate 13, upper end plate 14 and lower end plate 15 are engaged with the outside of the assembly jigs 37.

In this manner, the fin plate 13 is provided between the first formed plate 11 and the second formed plate 12 so as to form the joined body 8, and a plurality of joined bodies 8 are stacked by the aforementioned method. The upper end plate 14 is provided on the upper end of the stacked body, and the lower end plate 15 is provided on the lower end of the stacked body. After that, the upper end bracket 5 and the lower end bracket 4 are assembled onto the stacked body, and then, for example, the stacked body is put into a furnace so that the stacked body can be integrally joined by means of brazing so as to manufacture the oil cooler 1.

With reference to FIGS. 1 to 10, the operation of this oil cooler 1 will now be explained.

Engine oil for lubricating the mechanical portions of the engine 2 flows into the oil cooler 1 from the plurality of inlet opening portions 4b formed in the lower end bracket 4 through the outflow passage 2a formed in the engine 2 as shown by the solid line arrow in FIG. 1.

As shown by the broken line arrow in FIG. 1, engine oil flows into the plurality of flow pipes 34 from the first communicating holes 31a, 32a, 32b formed in the lower end plate 15 through the plurality of inlet opening portions 4b formed in the lower end bracket 4. As shown by the broken line arrows in FIGS. 1, 9 and 10, the engine oil that has flown into the plurality of flow pipes 34 flows in the longitudinal direction of each flow pipe 34. That is, the engine oil passes through the first communicating holes 20a, 21a, 21b formed in the second formed plate 12, the first communicating apertures 24a, 25a, 25b formed in the fin plate 13, and the first communicating holes 16a, 17a, 17b formed in the first formed plate 11.

On the other hand, as shown by the solid line arrow in FIG. 1, engine cooling water in the cooling water pipe flows into the cooling water passage 36 of the oil cooler 1 from the communicating port 30 formed in the upper end plate 14 through the inlet pipe 5d and the cooling water passage 5c formed in the upper end bracket 5. As shown by the solid line arrows in FIGS. 1, 9 and 10, the engine cooling water that has flowed into the cooling water passage 36 is guided to between the joined bodies 8 adjacent to each other and is also guided around the plurality of flow pipes 34. That is, as shown in FIGS. 9 and 10, the engine cooling water flows through the inner frame portion 16 of the first formed plate 11, the first connection members 18, 19 and arc portions 181, 191 formed in the first formed plate 11 as if the cooling water flows around the aforementioned portions.

Also, the engine cooling water flows through the inner frame 24, connection members 26, 27 and arc portions 261, 271 formed in the fin plate 13 as if the engine cooling water sews the aforementioned portions.

Further, the engine cooling water flows through the inner frame portion 20, the second connection members 22, 23, and arc portions 221, 231 formed in the second formed plate 12 as if the engine cooling water flows around the aforementioned portions. After that, the engine cooling water passes through the second communicating holes 19*a* to 19*c* formed in the first formed plate 11, the second communicating openings 26*a* to 26*c* formed in the fin plate 13, and the second communicating holes 23*a* to 23*c* formed in the second formed plate 12.

As a result of the foregoing, when the engine oil flows in the plurality of flow pipes 34 in the stacking direction of the joined body 8 as shown by the broken line arrows in the drawing, heat is exchanged through the flow pipes 34 between the engine oil and the engine cooling water that flows in the surface direction of the joined body 8 as if the engine cooling water flows around the outer portions of the plurality of flow pipes 34, so that the engine oil is cooled.

As shown by the broken line arrow in FIG. 1, the cooled engine oil flows out from the first communicating holes 28*a*, 29*a*, 29*b* formed in the upper end plate 14, and discharged to the outside of the oil cooler 1 from a plurality of outlet openings 5*b* formed in the upper end side bracket 5.

The engine oil discharged to the outside of the oil cooler 1 flows into the oil filter 3 and is filtered. After that, the engine oil flows into the union 6 from the end portion of the union 6 on the side of the oil filter 3 as shown by the broken line arrow in FIG. 1. Then, the engine oil passes through the communicating passages 6*a* and returns into the inflow passage 2*b* of the engine 2 from the end portion of the union 6 on the side of the engine 2. The engine oil is guided to an oil pan or sliding portions by this inflow passage 2*b*.

As shown by the solid line arrow in FIG. 1, the engine cooling water heated by the heat of the engine oil flows out to the outside of the oil cooler 1 from the outlet pipe portion 5*f* through the communicating port 30*b* formed in the upper end plate 14 and the cooling water passage 5*e* formed in the upper end bracket 5, and then the cooling water is cooled by a radiator (not shown) and returned to the oil cooler 1.

As explained above, in this embodiment, the joined body 8 is made when the fin plate 13 is provided between the first and the second formed plates 11 and 12 that have been formed by means of press punching, and a plurality of joined bodies 8 are stacked so that the heat exchanging section 7 is manufactured. In this way, a plurality of flow pipes 34 are formed in the stacking direction, and a plurality of oil passages 35 are formed inside the flow pipes 34. Accordingly, no expanded portions are formed in the first formed plate 11, second formed plate 12 and fin plate 13, so that a larger number of flow pipes 34 can be disposed in the same volume and the radiating area can be increased. Further, no projections to block the flow of engine oil are formed in the extending direction of the flow pipe 34. Consequently, the velocity of flow of engine oil is increased in the positions close to the wall when the engine oil passes in the flow pipe 34. As a result, the heat exchanging efficiency between engine oil and engine cooling water can be improved.

Further, the first formed plate 11, second formed plate 12 and fin plate 13 are formed only by means of press punching, so that firm contact between the surfaces to be brazed can be easily ensured in the case where these plates are to be brazed to each other. Furthermore, the plates can be closely contacted to each other without causing fluctuation, so that the occurrence of brazing failure can be prevented. Since do not bent portions exist in each plate, the strength of the plate is high, and the occurrence of buckling can be prevented when the oil filter 3 is tightened by the union 6.

Figure 11:
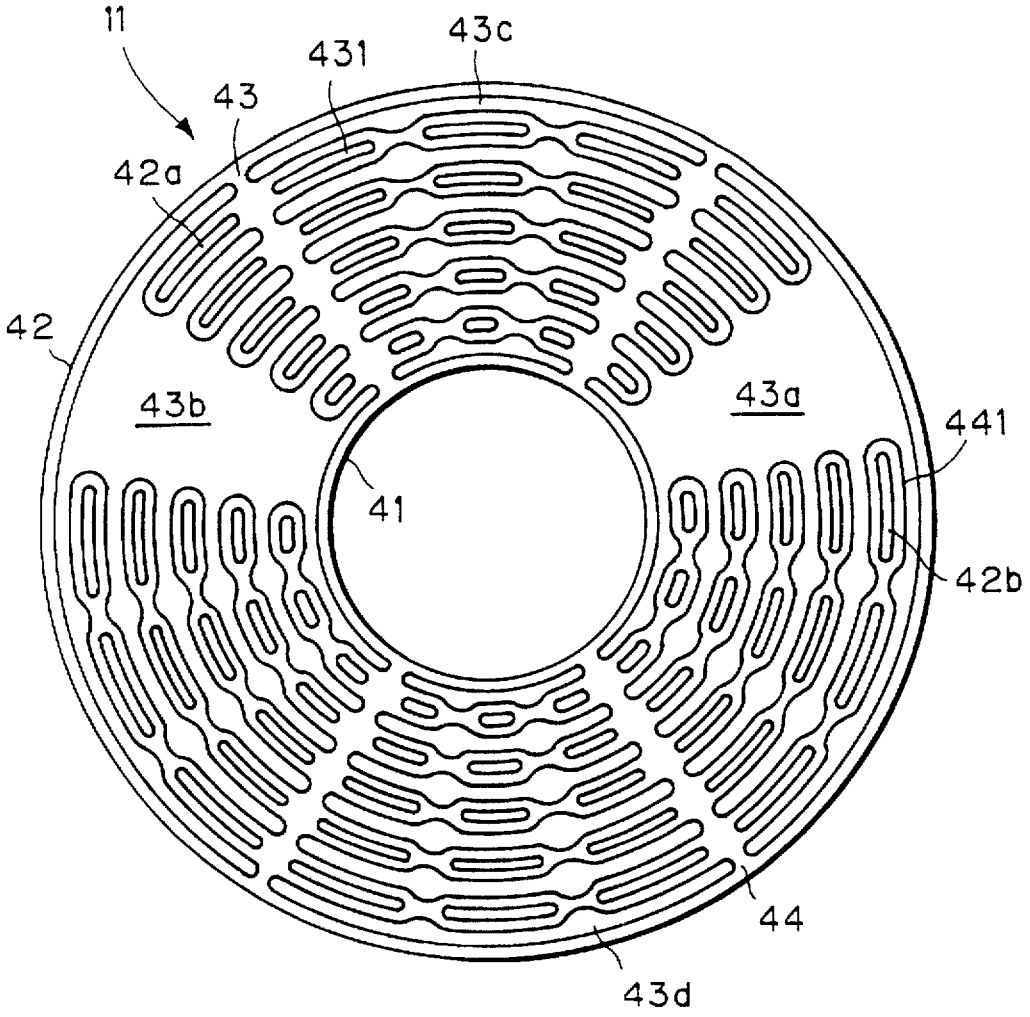
FIGS. 11 and 12 are plan views showing the first and second formed plates of the second embodiment, respectively.
Figure 12:
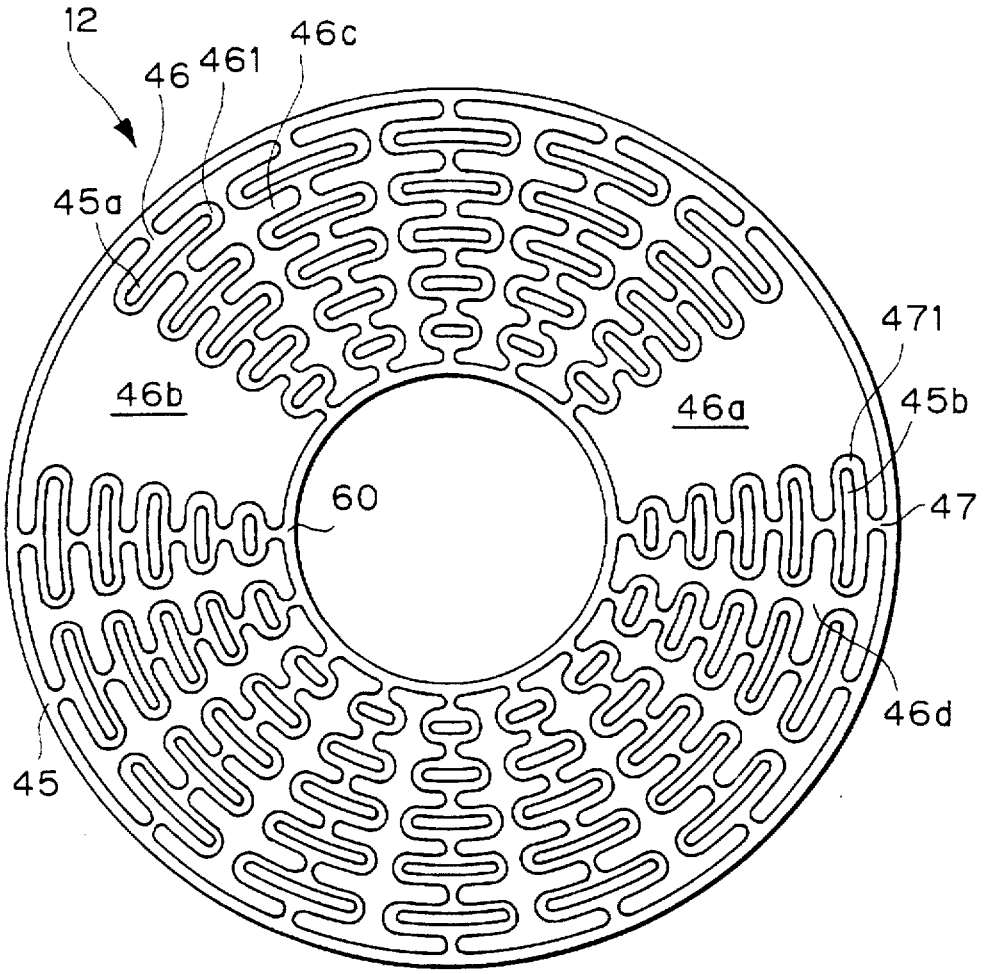

FIGS. 11 and 12 show the second embodiment of the present invention. FIG. 11 is a view showing the first formed plate, and FIG. 12 is a view showing the second formed plate.

An annular inner frame portion 41 is formed on the end surface on the inner circumferential periphery side of the first formed plate 11, and an annular outer frame portion 42 is formed on the end surface on the outer circumferential periphery side of the first formed plate 11.

In FIG. 11, on the outer circumferential side of the inner frame portion 41 on the upper side, five rows of arc portions 431 connected by the two first connection members 43 are successively formed on the outer frame portion 42. The five first communicating holes 42*a* in which engine oil flows are provided on the same circumference in the arc portion 431 in each row.

Further, in FIG. 11, on the outer circumferential side of the inner frame portion 41 on the lower side, the arc portions 441 are successively formed that are connected by the two first connection members 44 from the inner frame portion 41 to the outer frame portion 42. In the arc portion 431 of each row, the nine first communicating holes 42 in which engine oil flows are formed on the same circumference.

In the portions between the upper arc portion 431 and the lower arc portion 441, the portions being divided by the first connection members 43, 44, the second communicating holes 43*a*, 43*b* are provided in which engine cooling water flows. Also, between the first connection members 43 adjacent to each other, and around the arc portion 431, the second communicating hole 43*c* in which engine cooling water flows is provided. Further, between the first connection members adjacent to each other, and around the arc portion 441, the second communicating hole 43*d* is provided in which engine cooling water flows.

In the first formed plate 11, the wall portion of this embodiment is composed of the inner frame portion 41, outer frame portion 42, first connection members 43, 44 and arc portions 431, 441.

In the second formed plate 12, an inner frame portion 60 is provided in a position corresponding to the inner frame portion 41, and an outer frame portion 45 is provided in a position corresponding to the outer frame portion 42.

In FIG. 12, on the outer circumferential side of the inner frame portion 60 on the upper side, five arc portions 461 connected with each other by the five second connection members 46 are provided in the circumferential direction from the inner frame portion 60 to the outer frame portion 45.

In each arc portion 461, the five first communicating holes 45*a* respectively communicating with the first communicating hole 42*a* are successively formed in the radial direction.

Further, in FIG. 12, on the outer circumferential side of the inner frame 60 on the lower side, five arc portions 471 connected with each other by the nine second connection members 47 are successively provided from the inner frame portion 60 to the outer frame portion 45. In each arc portion 471, the nine first communicating holes **45*b* respectively communicating with the first communicating hole 42*b*** are successively provided in the radial direction.

In the portions between the upper plate wall portion 461 and the lower plate wall portion 471, the portions being divided by the second connection members 46, 47, the second communicating holes **46*a*, 46*b* respectively communicating with the second communicating holes 43*a*, 43*b* are provided. Between the second connection members 46 adjacent to each other, the second communicating hole 46*c* respectively communicating with the second communicating hole 43*c* is formed. Further, between the second connection members 47 adjacent to each other, the second communicating hole 46*d* respectively communicating with the second communicating hole 43*d*** is provided.

In the second formed plate 12, the plate wall portion of the present invention is composed of the inner frame portion 60, outer frame portion 45, the second connection members 46, 47, and arc portions 461, 471.

Figure 13:
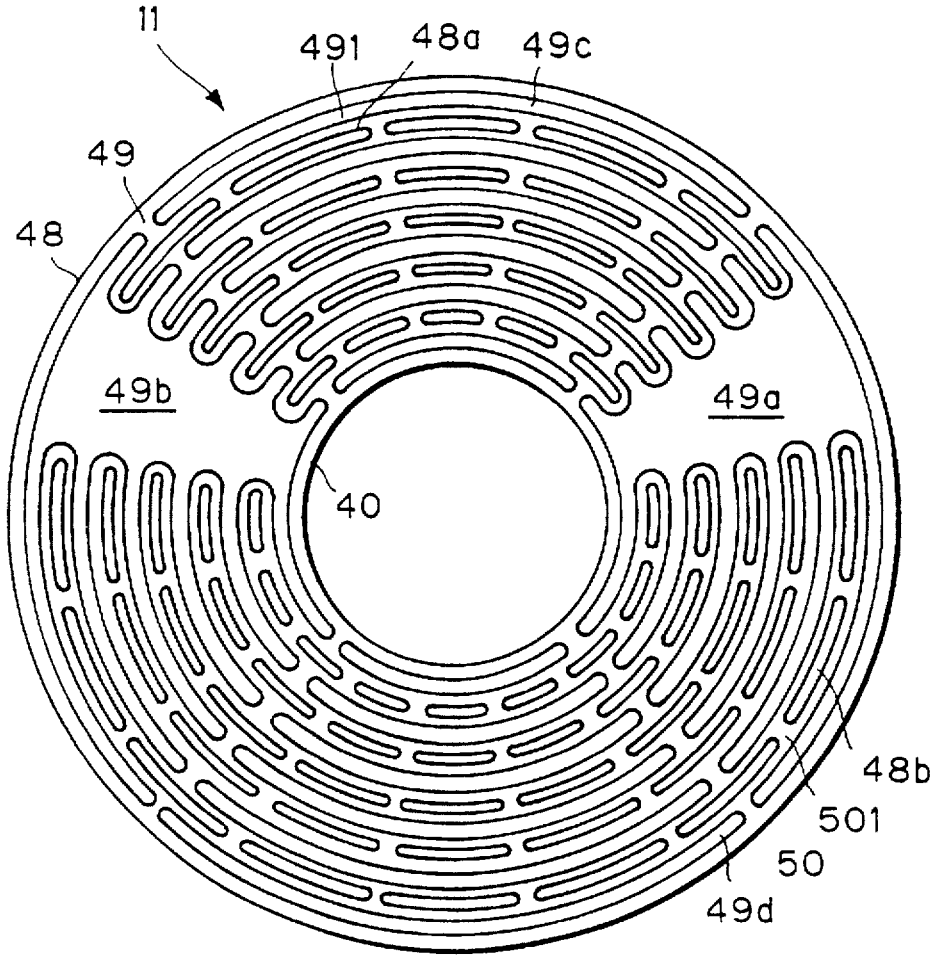
FIGS. 13 and 14 are plan views showing the first and second formed plates of the third embodiment, respectively.
Figure 14:
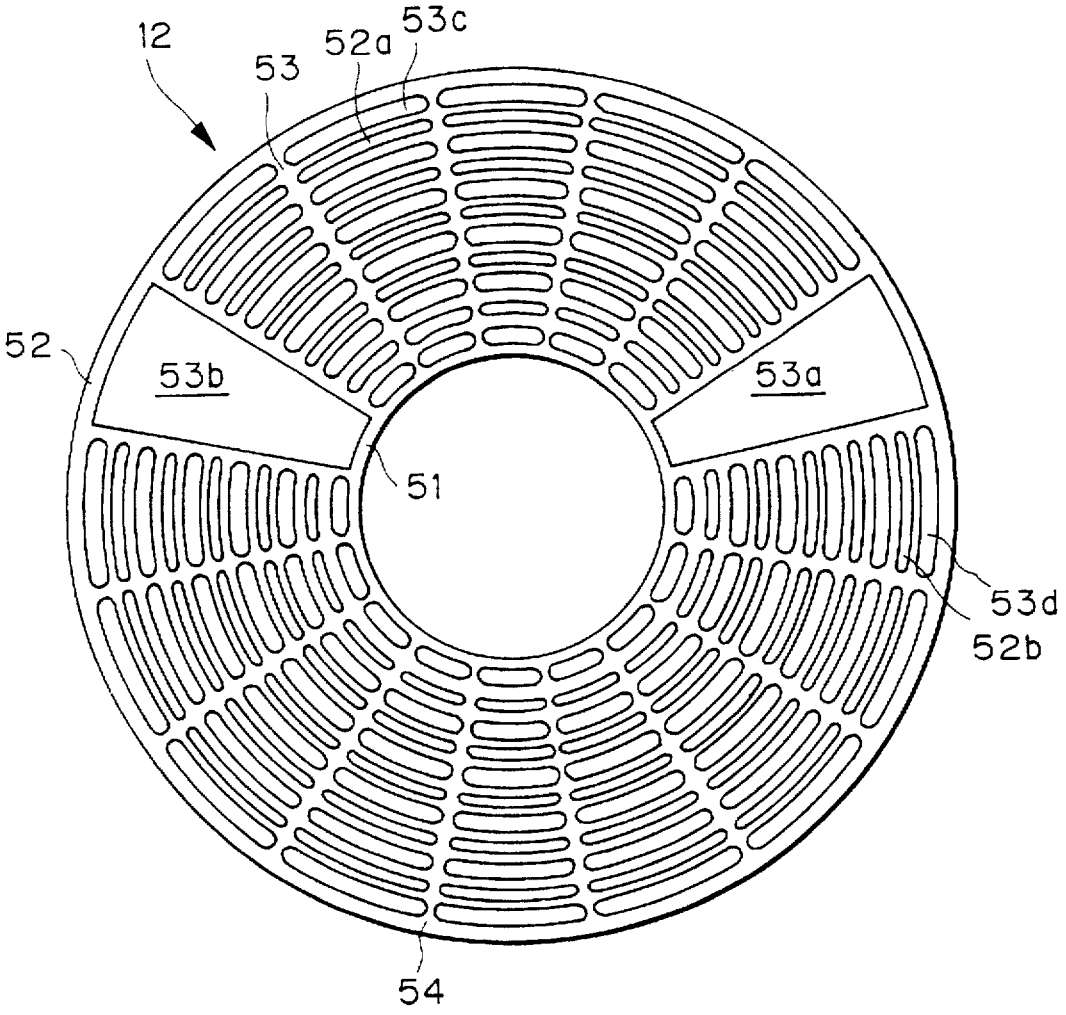
Figure 15:
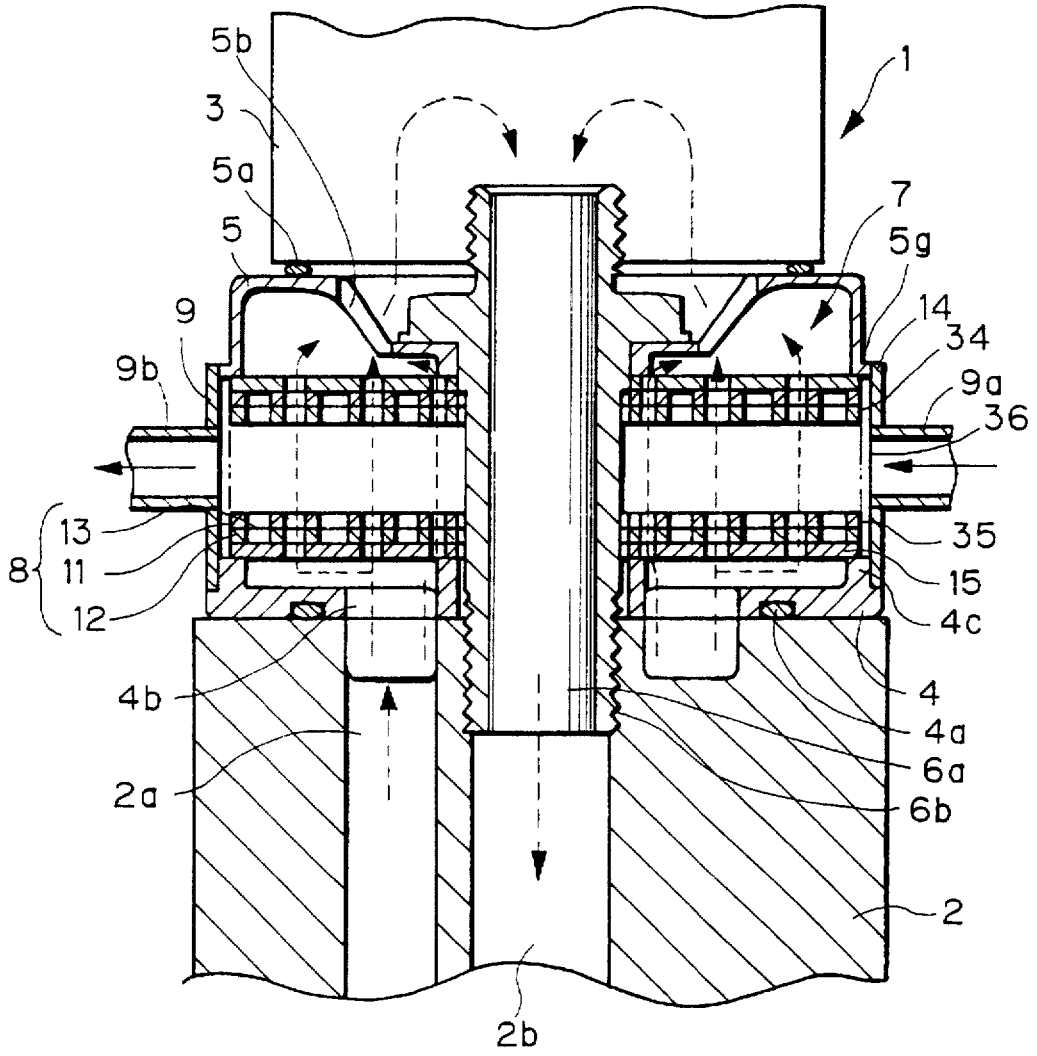

FIGS. 13 and 14 show the third embodiment of the present invention. FIG. 13 is a view showing the first formed plate, and FIG. 14 is a view showing the second formed plate.

The annular inner frame portion 40 is provided on the end surface on the inner circumferential periphery side of the first formed plate 11, and the annular outer frame portion 48 is provided on the end surface on the outer circumferential periphery side.

On the outer circumferential side of the inner frame portion 40 on the upper side of FIG. 13, five rows of arc portions 491 connected by the two first connection members 49 are successively provided from the inner frame 40 to the outer frame 48.

In the arc portion 491 in each row, the five first communicating holes **48*a*** in which engine oil flows are provided on the same circumference.

On the outer circumferential side of the inner frame portion 40 on the upper side of FIG. 13, five rows of arc portions 501 connected by the two first connection members 50 are successively provided from the inner frame 40 to the outer frame 48.

In the arc portion 501 in each row, the nine first communicating holes **48*b*** in which engine oil flows are provided on the same circumference.

In the portions between the upper arc portion 491 and the lower arc portion 501, the portion being divided by the first connection members 49, 50, the second communicating holes **49*a*, 49*b* in which engine oil flows are provided. Between the first connection members 49 adjacent to each other, and around the arc portion 491, the plurality of second communicating holes 49*c* in which engine oil flows are provided. Between the first connection members 50 adjacent to each other, and around the arc portion 501, the second communicating hole 49*d*** in which engine cooling water flows is provided.

In the first formed plate 11, the plate wall portion of the present invention is composed of the inner frame portion 40, outer frame portion 48, first connection members 49, 50, and arc portions 491, 501.

The second formed plate 12 is provided with an inner frame portion 51 in a position corresponding to the inner frame portion 40, and also provided with an outer frame portion 52 in a position corresponding to the outer frame portion 48. Two semicircular portions 53, 54 are respectively formed between the inner and outer frame portions 51 and 52. In the second formed plate 12, the plate wall portion of the present invention is composed of the inner frame portion 51, outer frame portion 52, and semicircular portions 53, 54.

In the semicircular portion 53 on the upper side in FIG. 14, the five first communicating holes **52*a* respectively communicating with the first communicating holes 48*a* are open onto the same circumference. In the semicircular portion 54 on the lower side in FIG. 14, the nine first communicating holes 52*b* respectively communicating with the first communicating hole 48*b*** are open onto the same circumference.

Between the two semicircular portions 53, 54, the second communicating holes **53*a*, 53*b* respectively communicating with the second communicating holes 49*a*, 49*b* are open. In the semicircular portion 53, between the first communicating holes 52*a* adjacent to each other, the second communicating hole 53*c* communicating with the second communicating hole 49*c* is provided. Further, in the semicircular portion 54, between the first communicating holes 52*b* adjacent to each other, the second communicating hole 53*d* communicating with the second communicating hole 49*d*** is provided.

Figure 16:
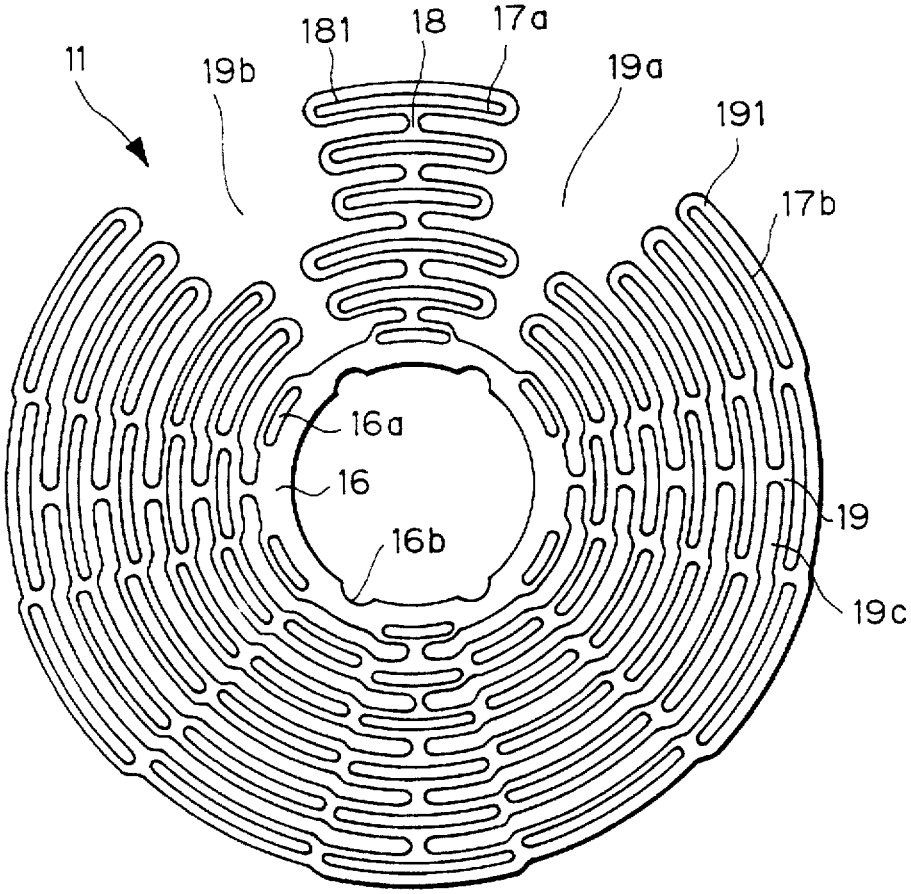
Figure 17:
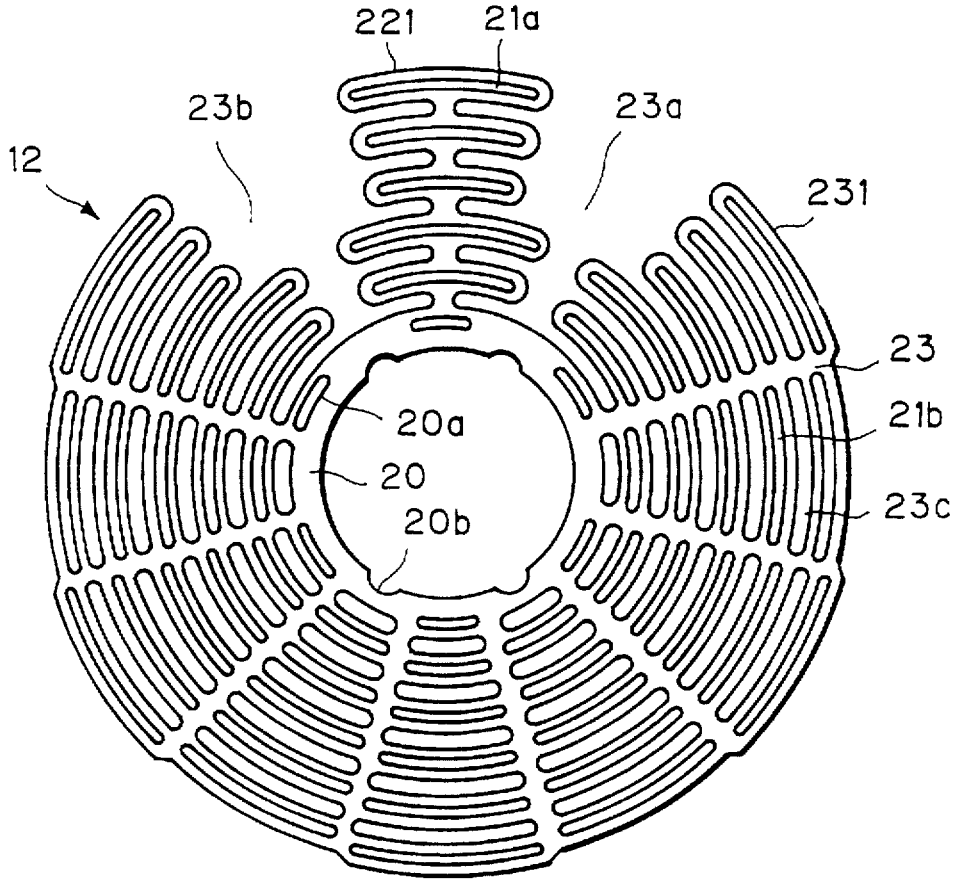
Figure 18:
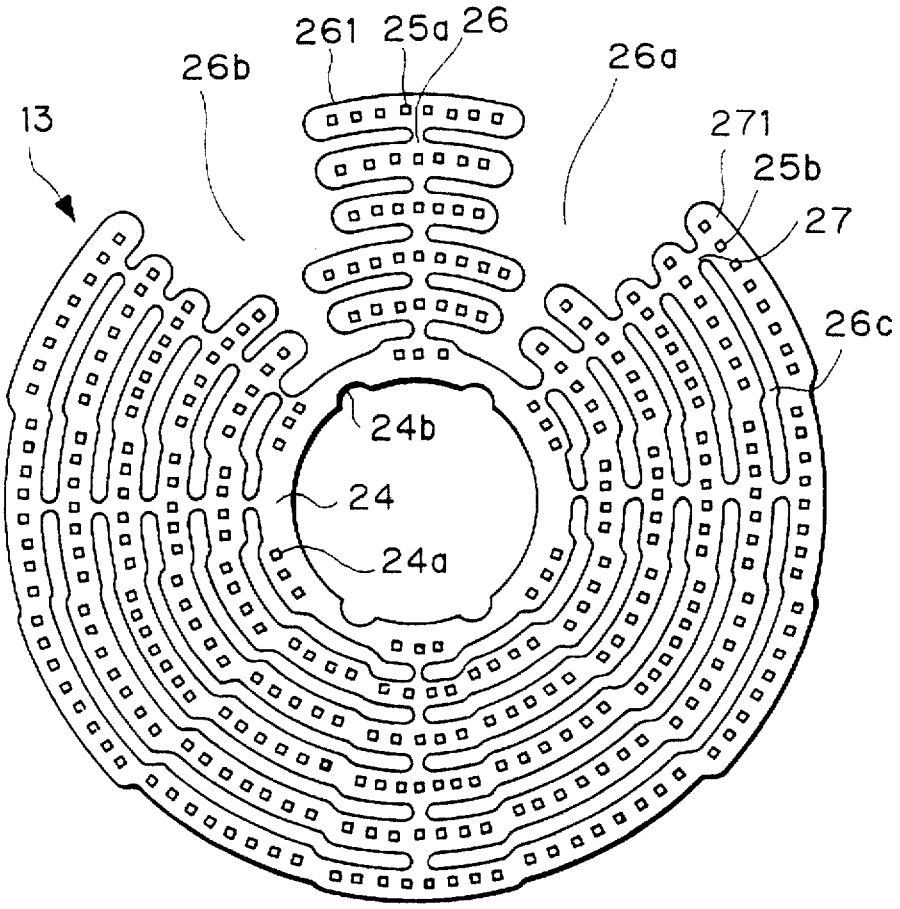

The fourth embodiment of the present invention is shown in FIGS. 15 to 18. FIG. 5 is a view showing an oil cooler. As shown in FIGS. 16 to 18, this embodiment shows a case in which the outer frame portions 17, 21, 25 are eliminated from the first formed plate 11, the second formed plate 12 and the fin plate 13 in the first embodiment and a housing is provided on the outer circumferential side of the heat exchanging section 7. Further, the inlet pipe portion **5*d* and the outlet pipe portion 5*f* are eliminated from the upper end bracket 5**.

The housing 9 is made of a metal such as an aluminum alloy, and is formed as a cylinder. The outer circumferential wall of the housing 9 is connected with the inlet pipe portion **9*a* through which engine cooling water flows into the housing 9, and also connected with the outlet pipe portion 9*b* through which engine cooling water flows out from the housing 9. The end portion of the housing 9 on the engine 2 side is engaged with the outer circumference of the outer cylindrical wall of the lower end bracket 4, and the end portion of the housing 9 on the oil filter 3 side is engaged with the flange portion 5*g* of the upper end bracket 5**, and these end portions are joined by means of brazing and the like.

Figure 19:
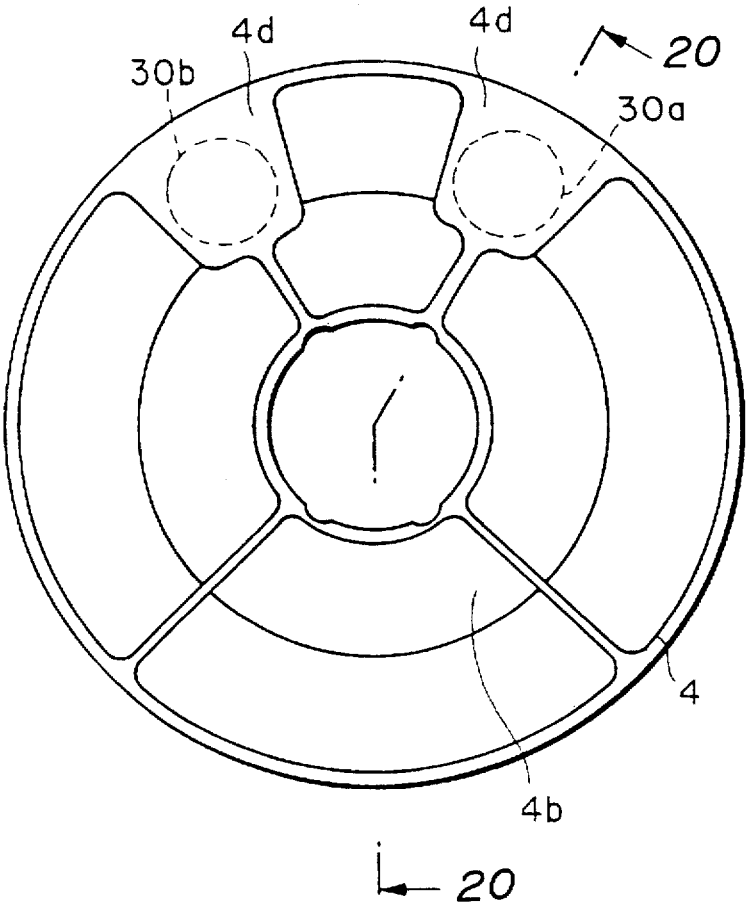
FIG. 19 is a plan view showing a lower end bracket of the fifth embodiment.
Figure 20:
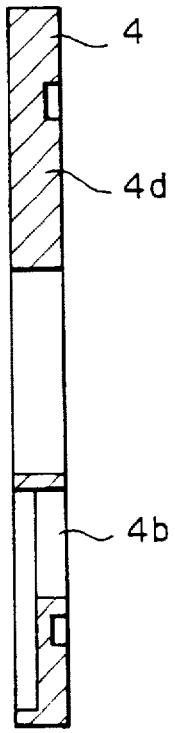
FIG. 20 is a sectional view taken on line 20—20 in FIG. 19.

FIGS. 19 and 20 are views showing the fifth embodiment of the present invention. In the drawings, the lower end bracket is shown.

The upper end plate 14 in the first embodiment is applied to the lower end plate 15 in this embodiment. Therefore, circular communicating ports **30*a*, 30*b* respectively communicating with the second communicating holes 19*a*, 23*a*, 19*b*, 23*b* are provided in the annular plate portion. In order to close the communicating holes 30*a*, 30*b*, an approximately trapezoidal seal portion 4*d* to be joined to the annular plate portion of the lower end plate 15 by means of brazing is provided at the lower end bracket 4. In the first embodiment, five kinds of plates are required for composing the heat exchanging section 7, however, the heat exchanging section 7** can be composed of four kinds of plates in this embodiment, so that the number of parts can be reduced.

Figure 21:
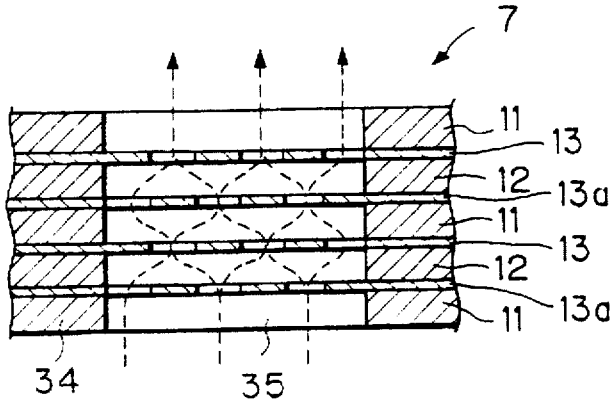
FIG. 21 is a sectional view showing a primary portion of the heat exchanger of the sixth embodiment.
Figure 22:
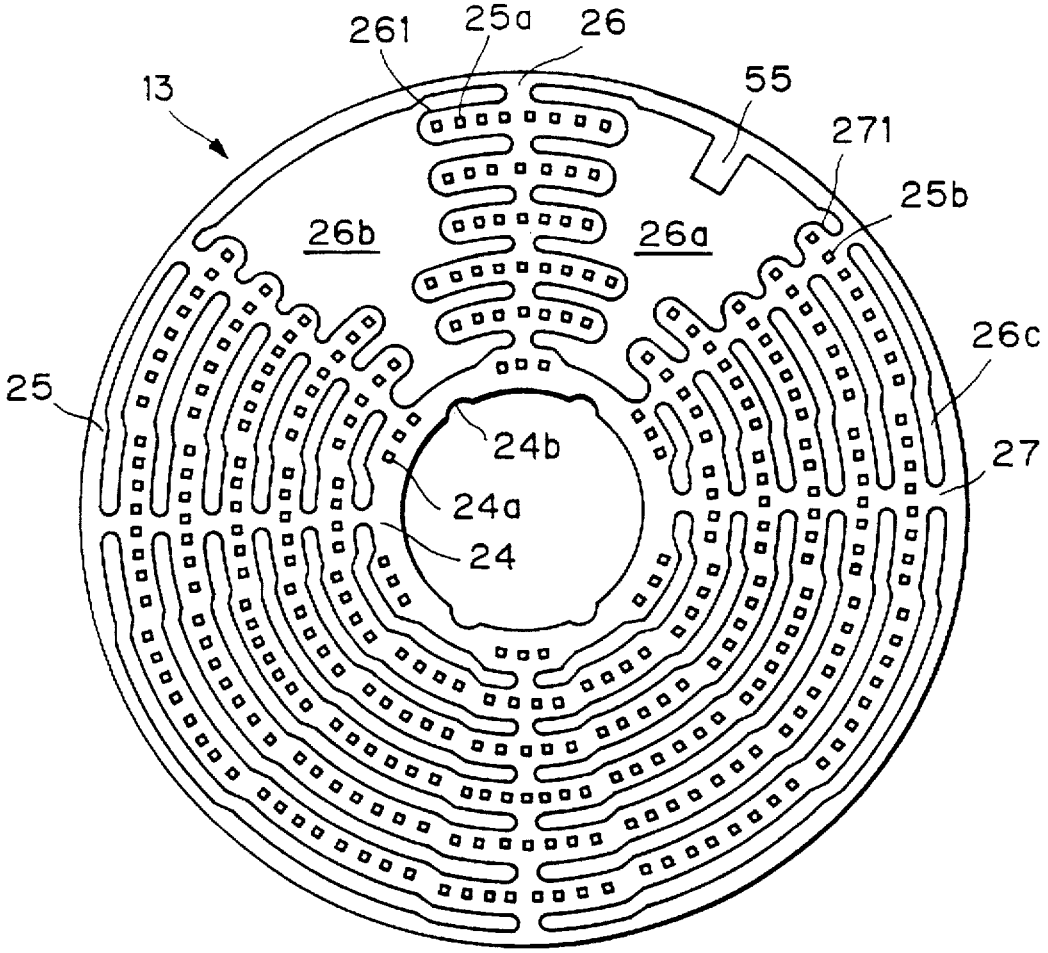
FIG. 22 is a plan view showing a fin plate.
Figure 23:
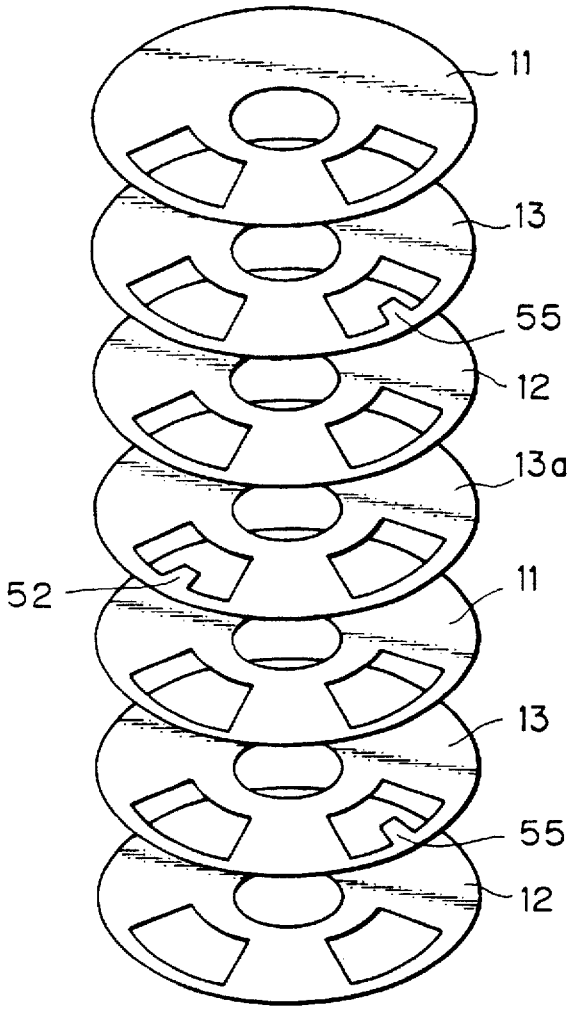
FIG. 23 is a perspective view showing an assembling method of the fin plate.

FIGS. 21 to 23 are views showing the sixth embodiment of the present invention. FIG. 21 is a view showing a primary portion of the heat exchanger 7, and FIG. 22 is a view showing the fin plate.

The fin plate 13 of this embodiment is structured in the following manner: a claw portion 55 is provided only in a portion facing the second communicating opening 26*a* on the inner circumference of the outer frame portion 25; and the configuration of the fin plate 13 is nonsymmetrical with respect to an imaginary line in the vertical direction.

As shown in FIG. 23, the heat exchanging section 7 is assembled with each fin plate 13 provided between the first and second formed plates 11 and 12 being inverted (the fin plate 13*a*). Accordingly, as shown in FIG. 21, the oil passages 35 are arranged in a zigzag manner in the heat exchanging section 7. Therefore, the heat exchanging efficiency of the heat exchanging section 7 is higher than that of the first embodiment.

The claw portion 55 is provided for the purpose of easily discriminating the assembling direction of the fin plate 13.

Figure 24:
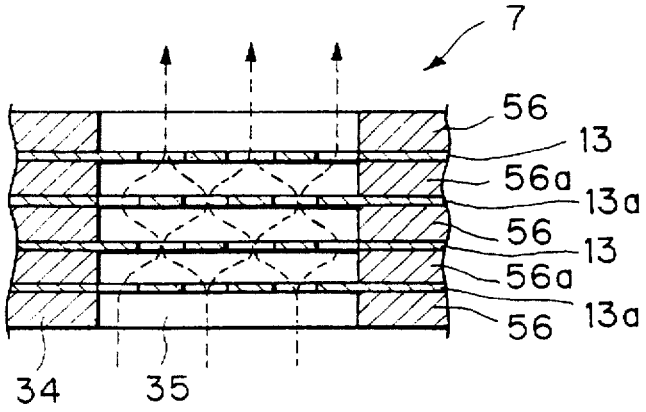
FIG. 24 is a sectional view showing a primary portion of the heat exchanger of the seventh embodiment and FIG. 25 is a plan view showing a formed plate.
Figure 25:
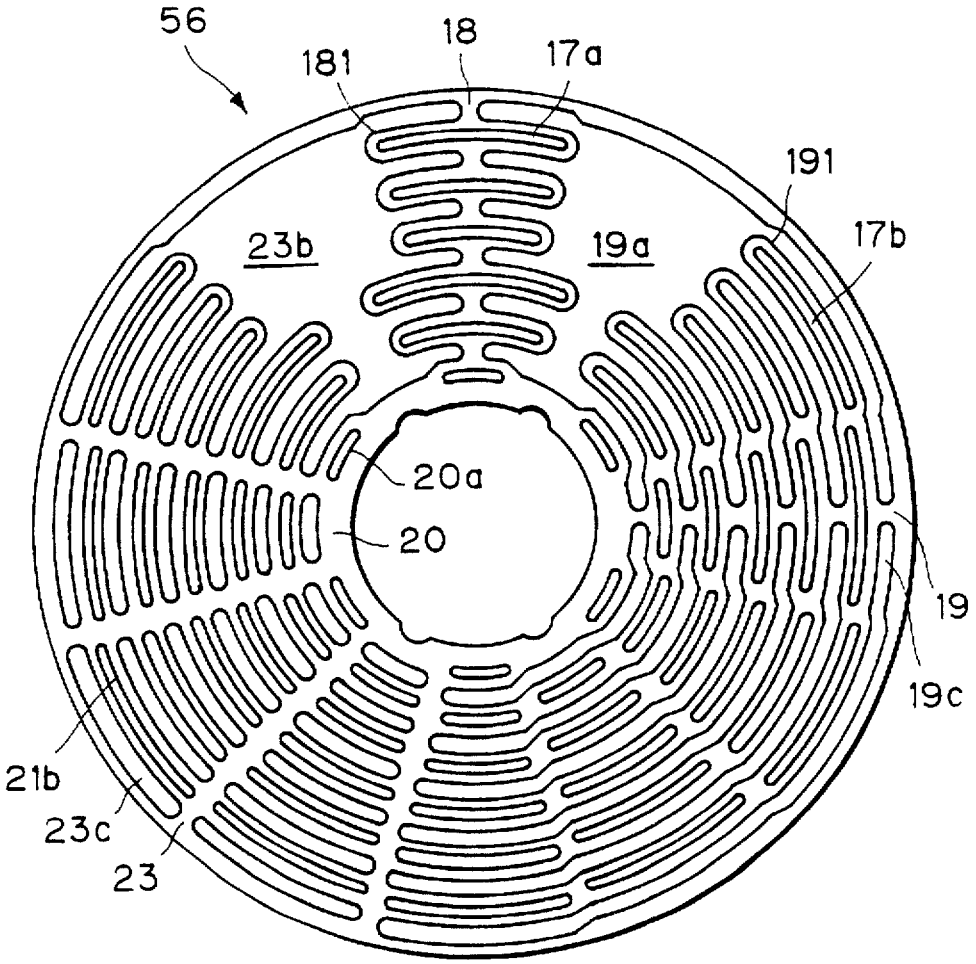

FIGS. 24 and 25 are views showing the seventh embodiment of the present invention. FIG. 24 is a view showing the heat exchanging section, and FIG. 25 is a view showing the formed plate.

The configuration of the right half of the formed plate 56 of this embodiment is made to be the same as that of the first formed plate 11 of the first embodiment, and the configuration of the left half is made to be the same as that of the second formed plate 12 of the first embodiment.

The heat exchanging section 7 is composed of a plurality of stacked joined bodies 8 structured in the following manner: the fin plate 13 is provided between the formed plate 56 and the formed plate 56*a*, the configuration of which is inverse to that of the formed plate 56; and the fin plate 13*a*, the configuration of which is inverse to that of the fin plate 13, is joined to the lower end surface of the formed plate 56*a*.

In the same manner as in the sixth embodiment, in the heat exchanging section 7, the oil passages 35 are disposed in a zigzag manner, so that the heat exchanging efficiency of the heat exchanging section 7 is improved as compared with the first embodiment.

Accordingly, in the first embodiment, three kinds of plates are required for composing the joined body 8, however, the joined body 8 can be composed of two kinds of plates in this embodiment, so that the number of parts can be reduced.

Figure 26:
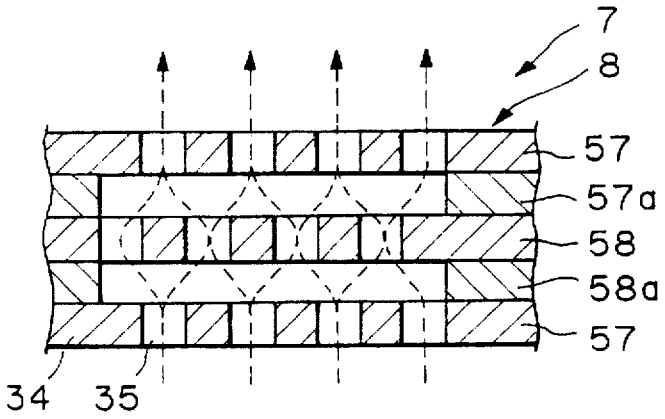
Figure 27:
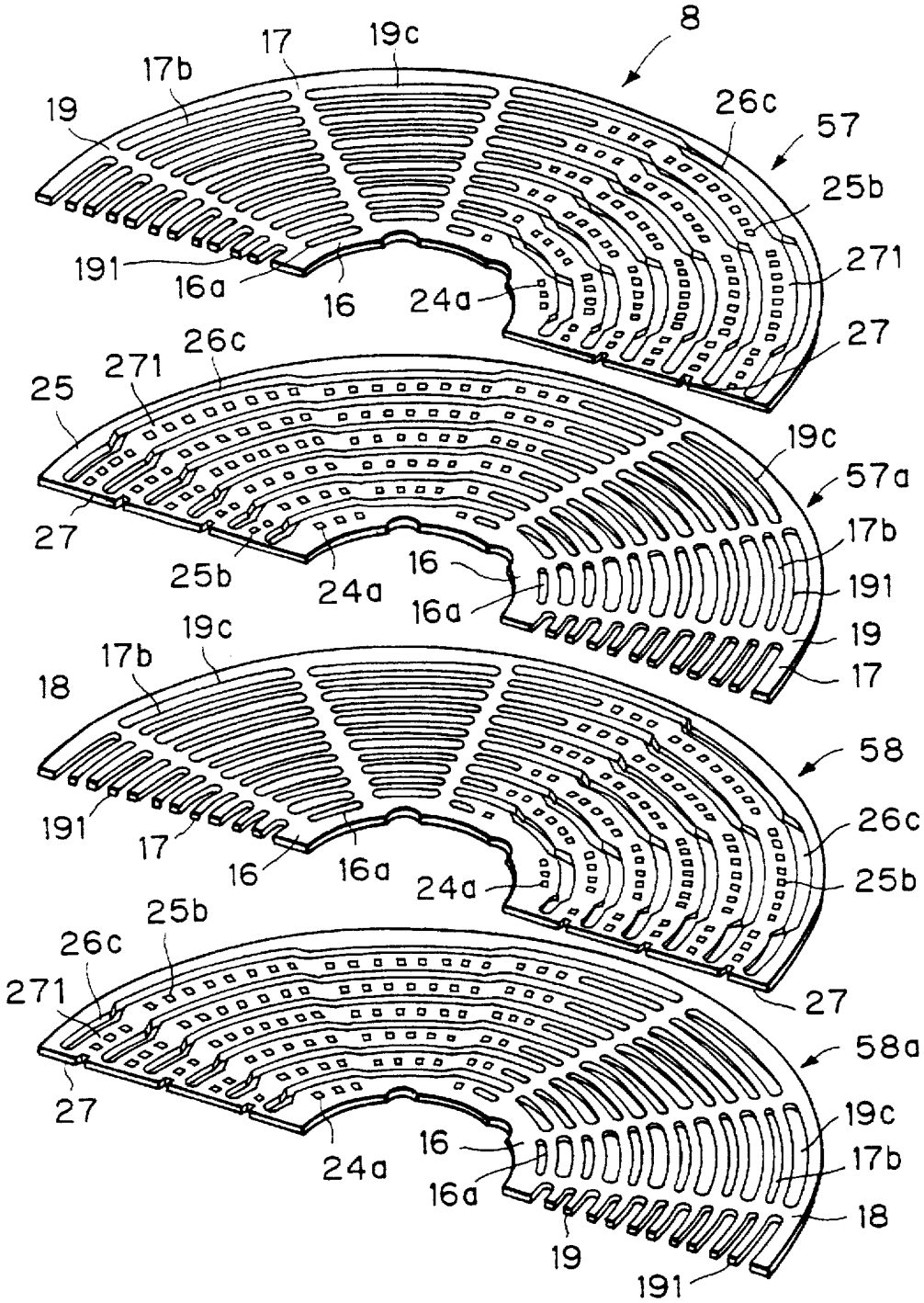

FIGS. 26 to 29 are views showing the eighth embodiment of the present invention. FIG. 26 is a view showing a primary portion of the heat exchanging section 7, and FIG. 27 is a view showing the joined body.

Figure 28:
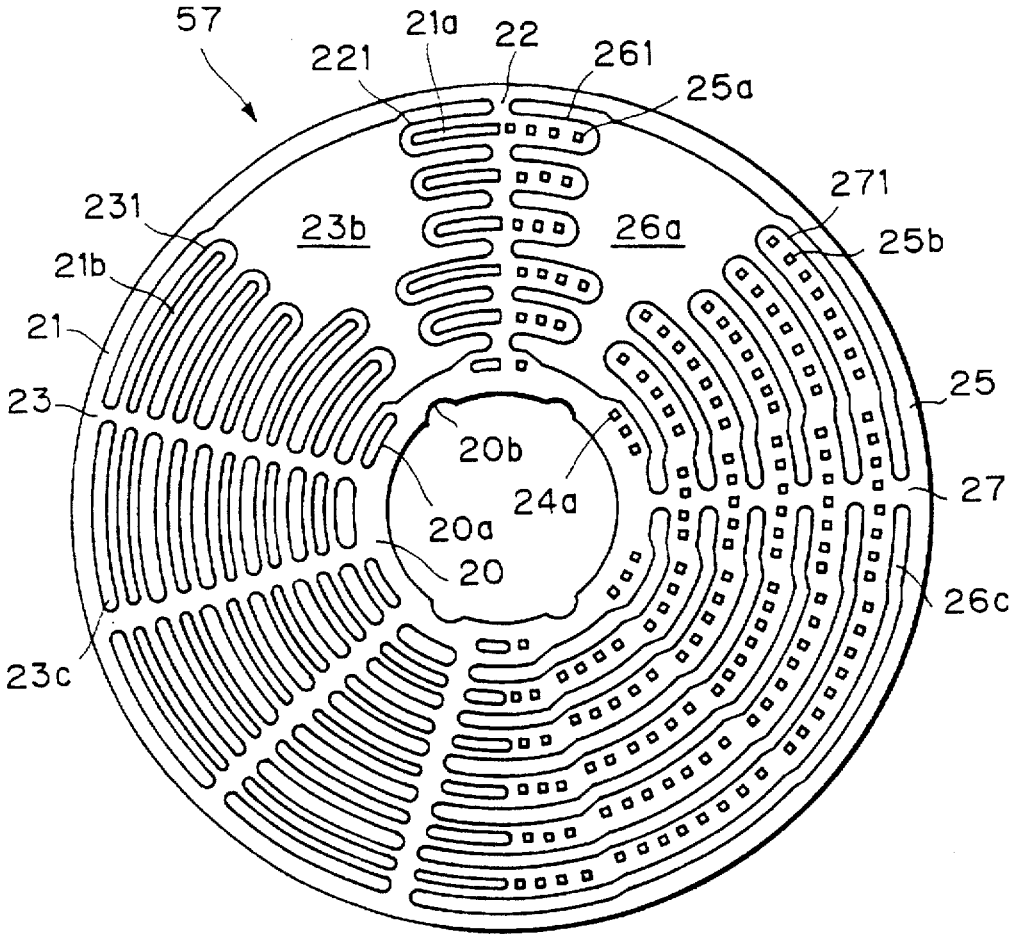

As shown in FIG. 28, the configuration of the left half of the first formed plate 57 of this embodiment is the same as that of the left half of the second formed plate 12 of the first embodiment, and the configuration of the right half is the same as that of the right half of the fin plate 13 of the sixth embodiment.

Figure 29:
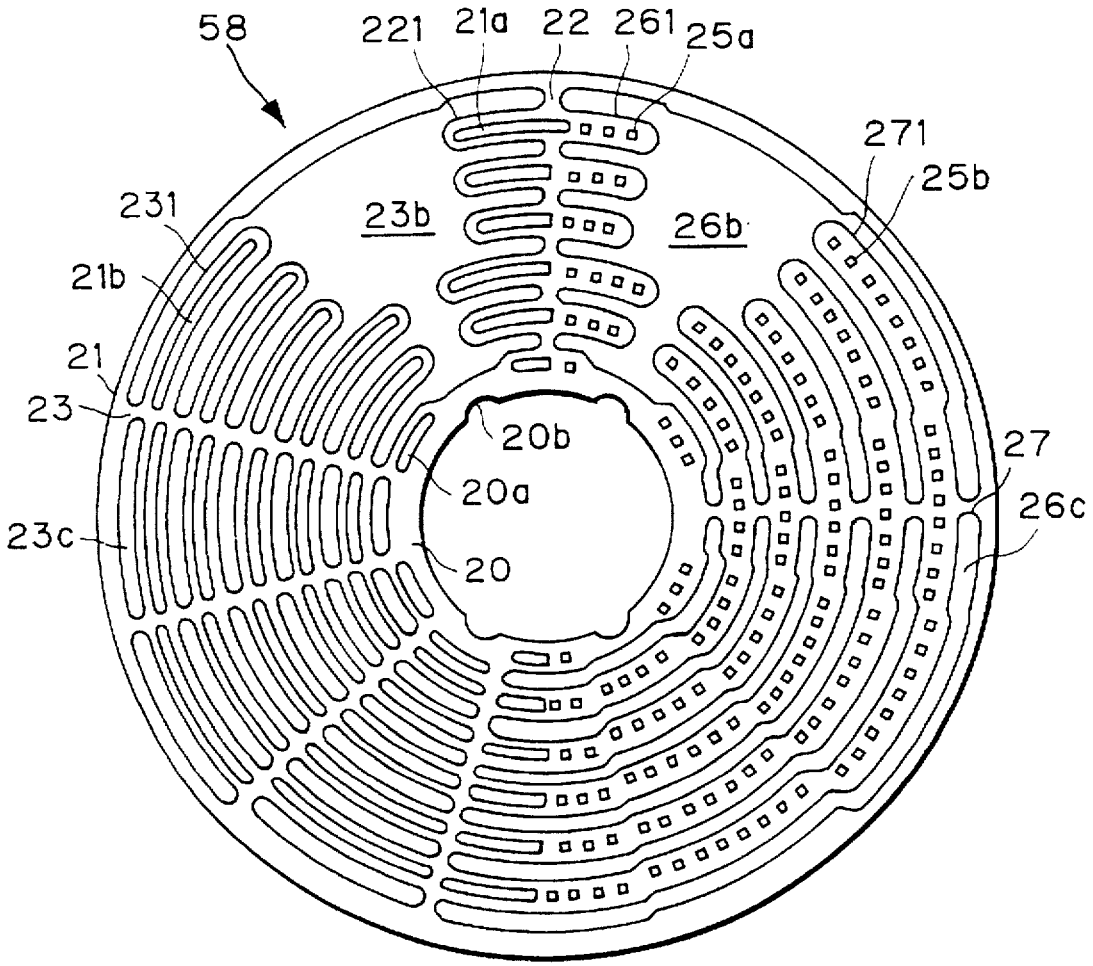
Figure 30:
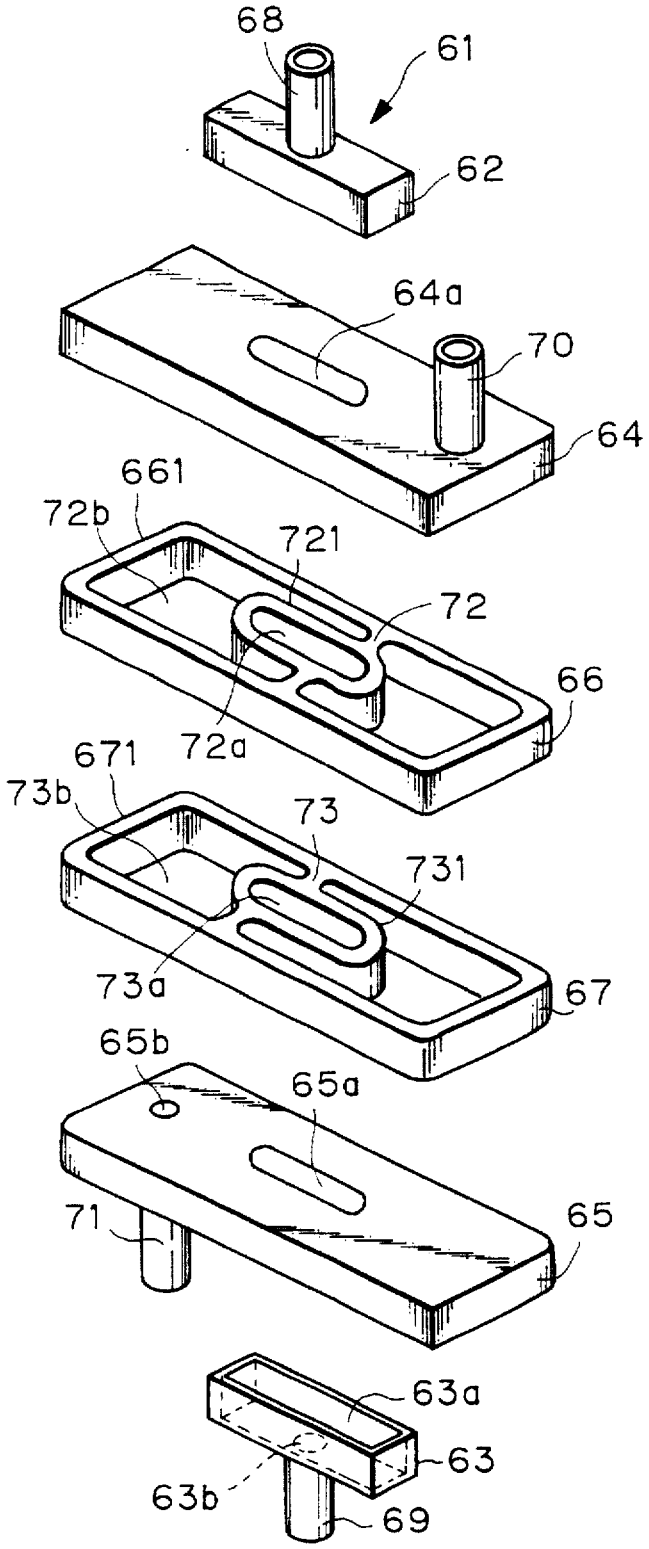
Figure 31:
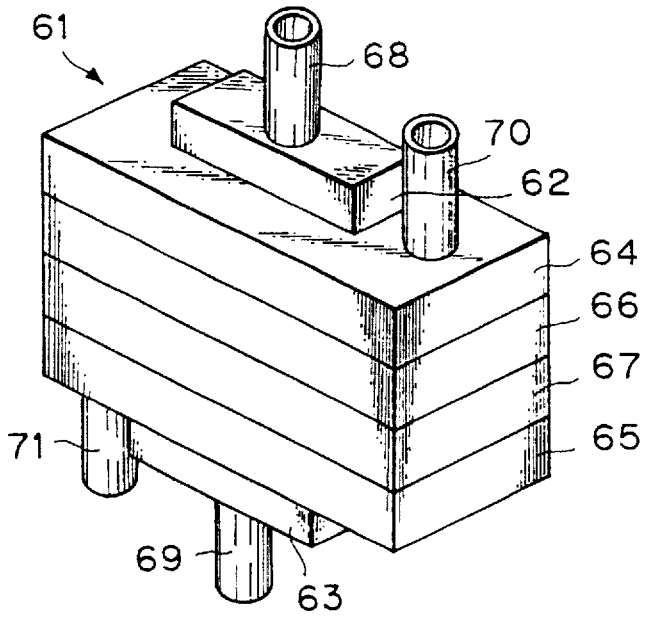
Figure 32:
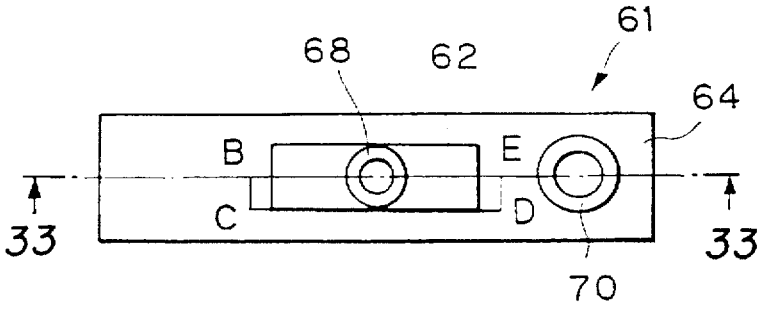

As shown in FIG. 29, the configuration of the left half of the second formed plate 58 is the same as that of the left half of the second formed plate 12 of the first embodiment, and the configuration of the right half is the same as but inverse to the left half of the fin plate 13 of the sixth embodiment.

The heat exchanging section 7 is composed of a plurality of stacked joined bodies 8 (shown in FIG. 27) including the first formed plate 57, first formed plate 57*a* inverse to the first formed plate 57, second formed plate 58, and second formed plate 58*a* inverse to the second formed plate 58, wherein the aforementioned plates are joined to each other.

As shown in FIG. 26, the oil passages 35 are arranged zigzag in the heat exchanging section 7. Therefore, the heat exchanging efficiency of the heat exchanging section 7 is higher than that of the first embodiment.

FIGS. 30 to 34 are views showing the ninth embodiment of the present invention, and a heat exchanger is shown in the drawings.

The heat exchanger 61 of this embodiment is composed of an upper end container 62, lower end container 63, upper end plate 64, lower end plate 65, first flat plate 66, and second flat plate 67.

The upper end container 62 is formed into a square box-shape, and an inlet chamber 62*a* into which the first heating medium (for example, engine oil) flows is formed inside the upper end container 62, and the end surface (the lower end surface) on the upper end plate 64 is open. A circular opening portion 62*b* communicating with the inlet chamber 62*a* is formed in the center of the ceiling wall of the upper end container 62. A circular inlet pipe 68 is extended upward from this opening portion 62*b*.

The configuration of a lower end container 63 is formed in such a manner that the upper end container 62 is reversed and the right and left portions are replaced with each other. In the same manner as the upper end container 62, an outlet chamber 63*a* and a circular opening portion 63*b* are provided. A circular outlet pipe 69 is extended downward from this opening portion 63*b*.

The upper end side plate 64 is formed rectangular, and a first oval communicating opening 64*a* communicating with the inlet and outlet chambers 62*a*, 63*a* is formed in the center. A second communicating opening 64*b* in which the second heating medium (for example, engine cooling water) passes through is formed in the right end portion of the upper end plate 64. A circular inlet pipe 70 is extended upward from this second communicating opening 64*b*.

The configuration of the lower end plate 65 is formed in such a manner that the upper end plate 64 is reversed and the right and left portions are replaced with each other. In the same manner as the upper end plate 64, a first oval communicating opening 65*a* is formed in the center, and a second communicating opening 65*a* is formed in the left end portion. A circular outlet pipe 71 is extended downward from the second communicating opening 65*b*.

The first flat plate 66 includes a square annular outer frame portion 661 composing the outer circumferential wall, and also includes an oval island-shaped portion 721 connected with the inner circumferential side of this outer frame portion 661 through a connection member 72. In this island-shaped portion 721, a first communicating hole 72*a* is formed. The first communicating hole 72*a* is open to a position corresponding to the first communicating openings 64*a*, 65*a*, and communicating with the inlet chamber 62*a*, outlet chamber 63*a*, and first communicating openings 64*a*, 65*a*. In a portion divided by the connection member 72 and surrounding the island-shaped portion 721, a second communicating hole 72*b* connected with the second communicating openings 64*b*, 65*b* is formed.

In the first flat plate 66, the plate wall portion of the present invention is composed of the connection member 72, outer frame portion 661, and island-shaped portion 721.

The second flat plate 67 includes a square annular outer frame portion 671 formed in a position corresponding to the outer frame portion 661, and also includes an oval island-shaped portion 731 connected with the inner circumferential side of this outer frame portion 671 through a connection member 73 that is disposed at a different position from the connection member 72. In this island-shaped portion 731, a first communicating hole 73*a* is formed that is open in a position corresponding to the first communicating openings 64*a*, 65*a* and the first communicating hole 72*a*, and that communicates with the inlet chamber 62*a*, outlet chamber 63*a*, first communicating openings 64*a*, 65*a*, and first communicating hole 72*a*. In a portion divided by the connection member 73 and surrounding the island-shaped portion 731, a second communicating hole 73*b* is formed that communicates with the second communicating openings 64*a*, 65*b* and the second communicating hole 72*b*.

In the second flat 67, the plate wall portion of the present invention is composed of the connection member 73, outer frame portion 671, and island-shaped portion 731.

After the aforementioned parts have been stacked in the order of the upper end container 62, upper end plate 64, first flat plate 66, second flat plate 67, lower end plate 65, and lower end container 63, they are joined by means of brazing. In this way, the heat exchanger 61 is manufactured. When the plates are stacked on each other, only one flat flow pipe 74 extending in the thickness direction can be formed in the heat exchanger 61. Further, in the flow pipe 74, a first heating medium passage 75 is formed through which the first heating medium flows from the upper end container 62 to the lower end container 63.

A second heating medium passage 76 in which the second heating medium flows is formed around the flow pipe 74.

With reference to FIGS. 30 to 34, the function of this heat exchanger 61 will be explained.

Figure 33:
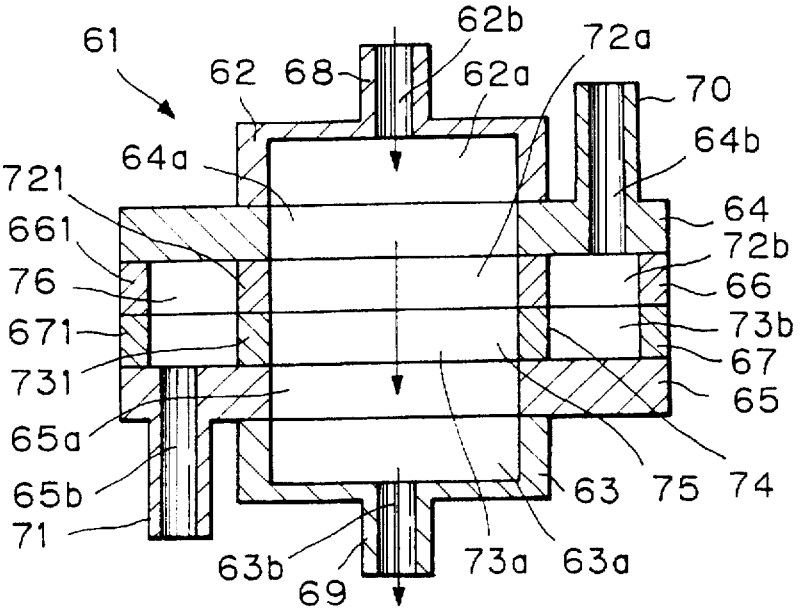

As shown by the solid line arrow in FIG. 33, the first heating medium flows into the inlet chamber 62*a* through the inlet pipe 68 formed in the upper end container 62. Then, as shown by the solid line arrow in FIG. 33, the first heating medium flows in the flow pipe 74 (the first heating medium passage 75) formed by the island-shaped portion 721 of the first flat plate 66 and the island-shaped portion 731 of the second flat plate 67, through the first communicating opening 64*a* formed in the upper end plate 64. That is, the first heating medium passes through the first communicating hole 72*a* formed in the first flat plate 66 and the first communicating hole 73*a* formed in the second flat plate 67.

Figure 34:
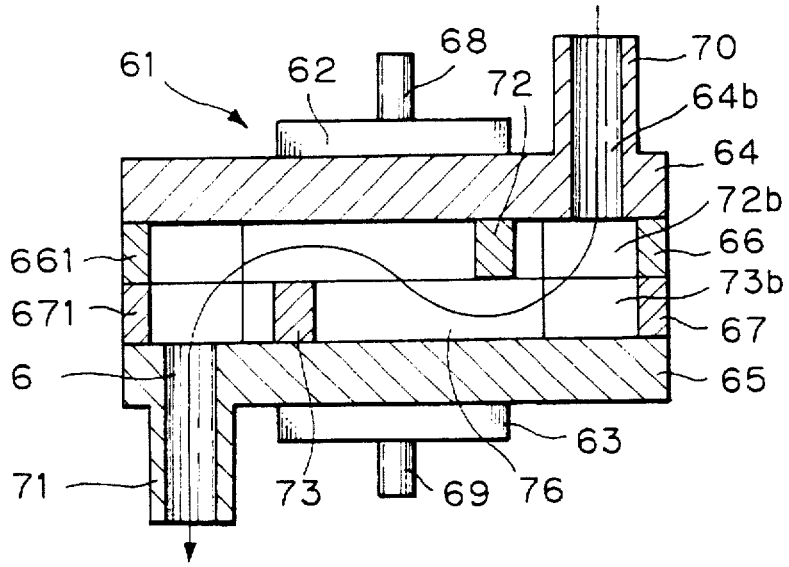

As shown by the solid line arrow in FIG. 34, the second heating medium flows into the second medium heat passage 76 through the inlet pipe 70 formed in the upper end plate 64. That is, the second heating medium passes through the two second communicating holes 72*b* as if it flows around the island-shaped portion 721 formed in the first flat plate 66 and the connection member 72. Further, the second heating medium passes through the second communicating hole 73*b* as if it flows around the island-shaped portion 731 formed in the second flat plate 67 and the connection member 73.

Then, the second heating medium that has passed through the second heating medium passage 76 passes through the second communicating opening 65*b* formed in the lower end plate 65, and flows out to the outside of the heat exchanger 61 from the outlet pipe 71.

Accordingly, when the first heating medium flows in the flow pipe 74 in the stacking direction of the heat exchanger 1, the first heating medium exchanges heat with the second heating medium flowing around the flow pipe 74 through the flow pipe 74.

After the heat exchanging operation has been completed, the first heating medium flows out to the outside of the heat exchanger 61 from the outlet pipe 69 through the first communicating opening 65*a* formed in the lower end plate 65 and the outlet chamber 63*a* formed in the lower end container 63.

In this example, no projection is provided to block the flow of engine oil in the extending direction of the flow pipe 74. Accordingly, the flow velocity of engine oil in a position close to the wall surface is increased when engine oil passes through the flow pipe 74. Therefore, the heat exchanging efficiency between engine oil and engine cooling water can be improved.

Figure 35:
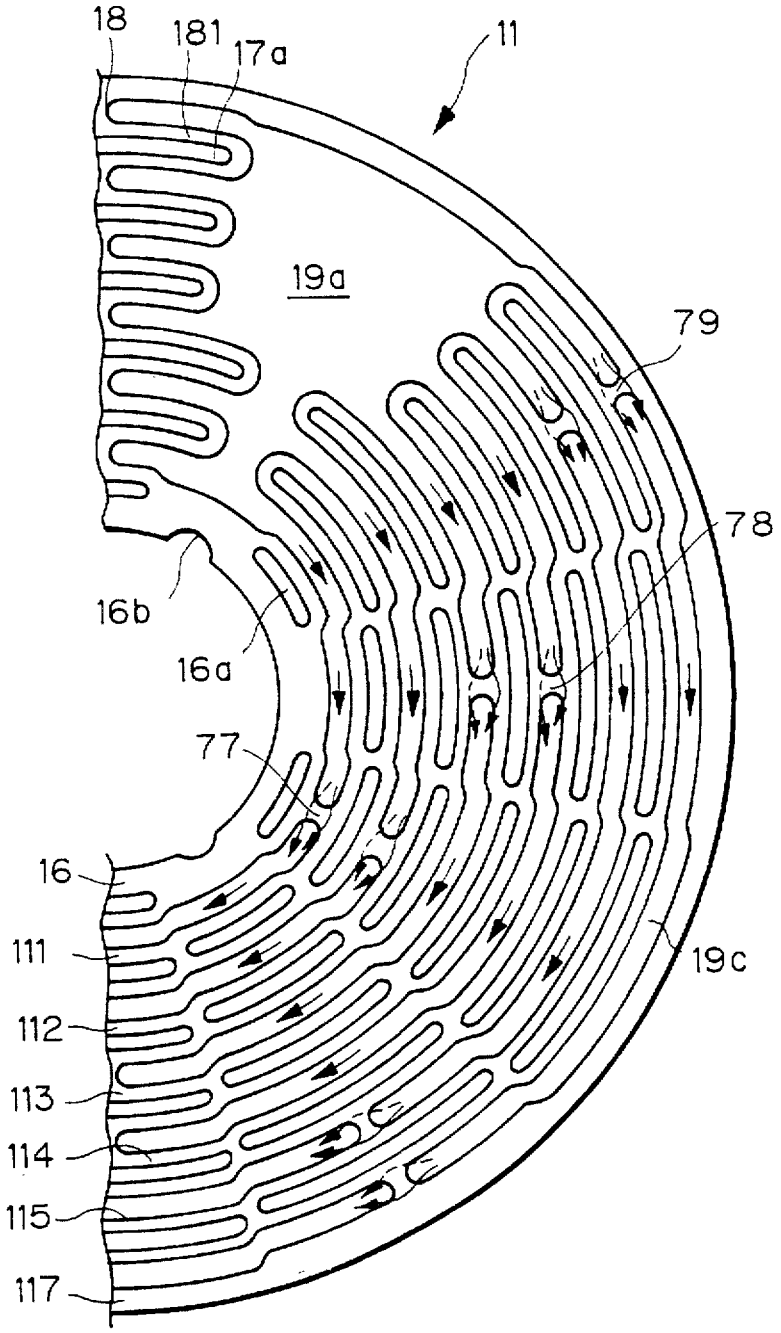
FIG. 35 is a plan view showing the first formed plate of tenth embodiment.

FIG. 35 is a view showing the tenth embodiment of the present invention, and the first formed plate is shown in FIG. 35.

This first formed plate 11 includes: a plurality of inner circumferential side connecting wall portions 77 that connects in the radial direction the inner frame portion 16 with the first and second rows of arc portions 111 and 112 formed on this inner frame portion 16; an intermediate connecting wall portion 78 that connects in the radial direction the second to fourth rows of arc portions 112 to 114; an the outer circumferential side connecting wall portion 79 that connects in the radial direction the outer frame portion 17 with the fourth and fifth rows of arc portions 114 and 115 formed on this outer frame 17 side, wherein these portions 77, 78 and 79 are provided in the first formed plate 11 in such a manner that the angles are shifted from each other. That is, the inner circumferential side connecting wall portion 77, intermediate connecting wall portion 78, and outer circumferential side connecting wall portion 79 are provided being shifted from each other so that they are not disposed on the same imaginary line extending in the radial direction from the center of the first formed plate 11.

Unlike the first embodiment in which all of six rows of second communicating holes 19*a* to 19*c* are provided with the connecting wall portion of the first connection member 19, only two rows of second communicating holes 19*a* to 19*c* are provided with the connecting wall portion in this embodiment. As a result of the foregoing, passage resistance against cooling water that flows into the second communicating holes 19*a* to 19*c* in a specific section of the first formed plate 11 can be reduced Angles of the connecting wall sections of the second formed plate 12 and the fin plate 13 may be shifted in the same way.

Figure 36:
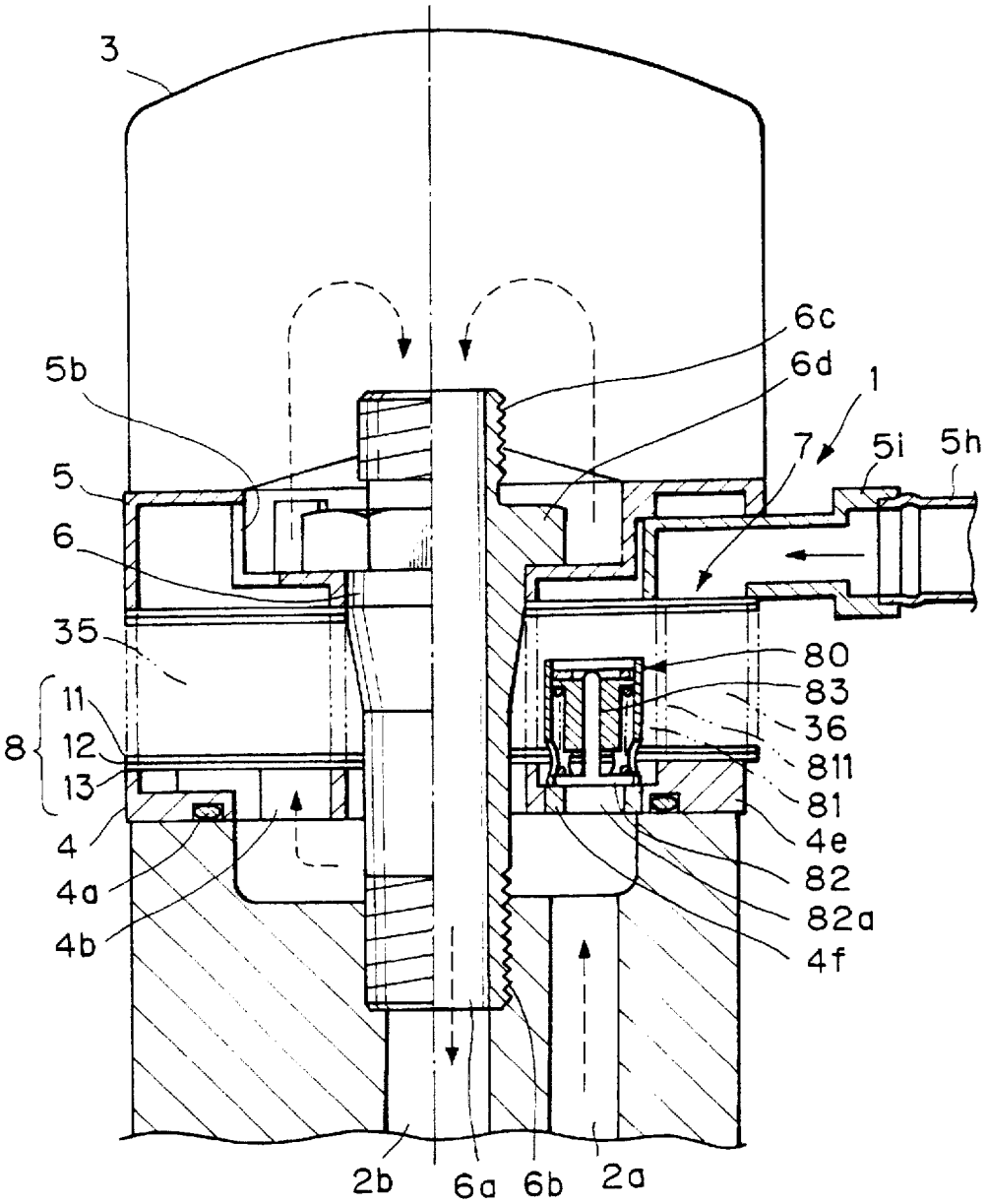
Figure 37:
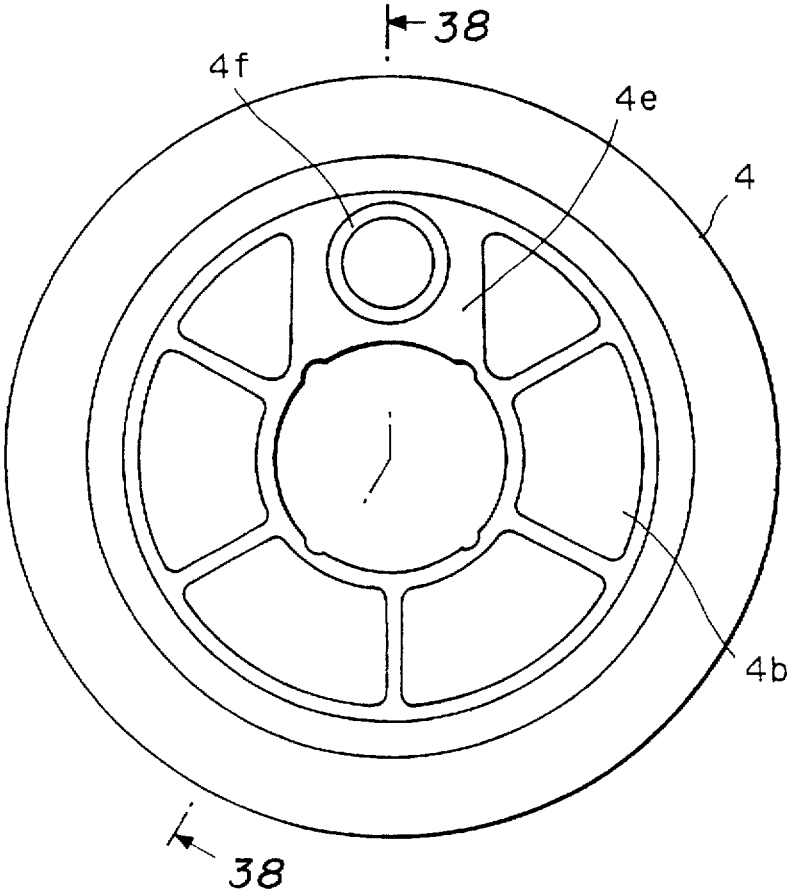
Figure 38:
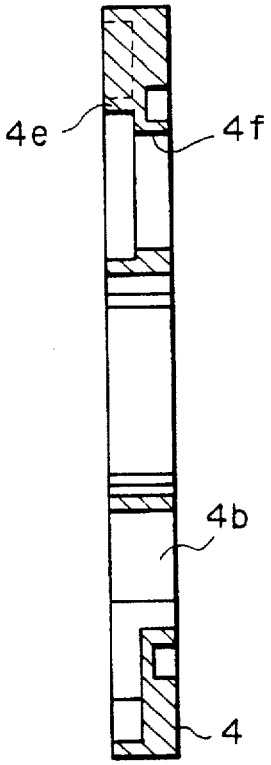

The eleventh embodiment of the present invention is shown in FIGS. 36 to 44. FIG. 36 is a view showing an oil cooler, and FIGS. 37 and 38 are views showing a lower end bracket.

As shown in FIG. 36, this oil cooler 1 is provided with a relief valve 80 to maintain the pressure in the heat exchanging section 7 at a predetermined value, and is also provided with a bypass passage 81 to bypass engine oil from a plurality of oil passages 35.

As shown in FIGS. 37 and 38, the lower end side bracket 4 is provided with an O-ring 4*a* between the bracket 4 and the engine, and a plurality of inlet openings 4*b* are formed to introduce engine oil into the heat exchanging section 7. In FIG. 37 showing the lower end bracket 4, an annular holding portion 4*f* that holds the relief valve 80 is provided in the upper end side wall portion 4*e*. The inner diameter of this holding portion 4*f* is smaller than that of the upper end side wall portion 4*e* on the heat exchanging section 7 side.

As shown in FIG. 36, an inlet pipe portion 5*i* to introduce the cooling water in the cooling water pipe 5*h* into the heat exchanging section 7 is attached to the upper end bracket 5.

Figure 39:
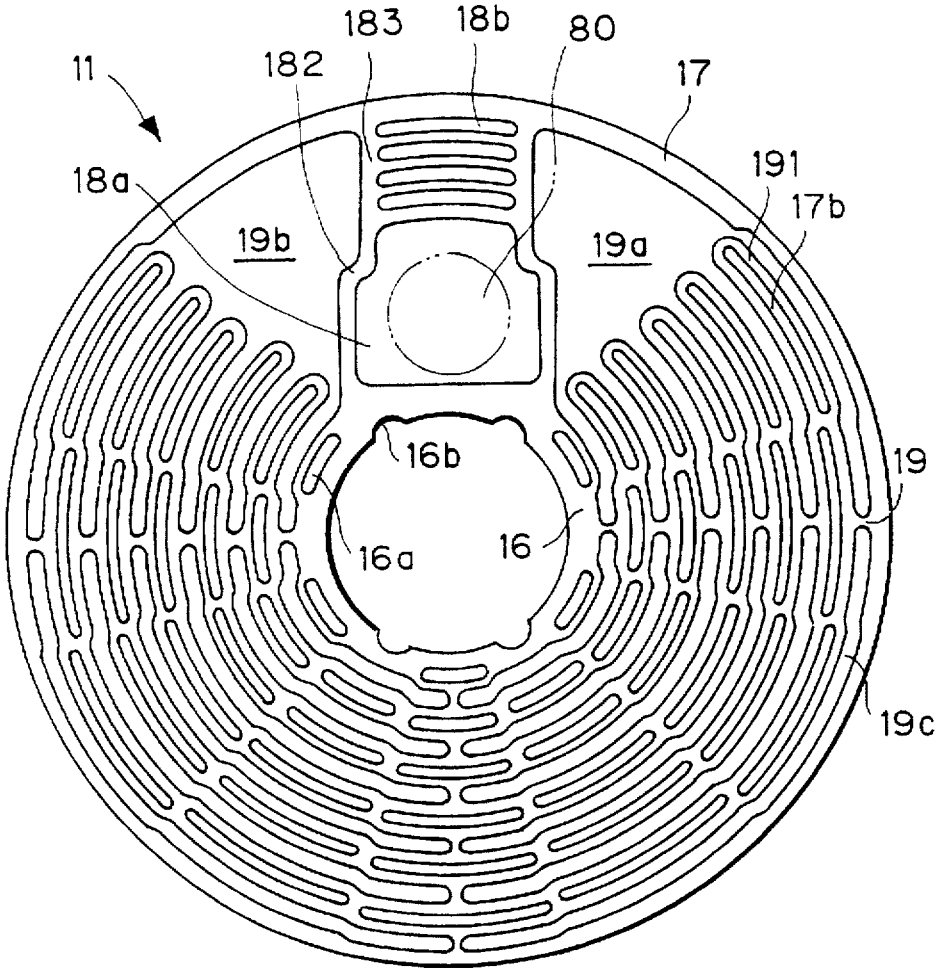

The first formed plate is shown in FIG. 39. In the first formed plate 11, a partition wall portion 182 to divide the second communicating holes 19*a* and 19*b* composing the cooling water passage 36 is formed between the upper side inner frame portion 16 and the upper side outer frame portion 17.

A protrusion-shaped bypass hole 18*a* in which engine oil flows is formed in the partition wall portion 182 on the inner circumferential periphery side so that the bypass hole 18*a* penetrates through the partition wall portion 182 in the thickness direction. As shown by a two-dotted chain line in the drawing, the relief valve 80 is provided in the bypass hole 18*a*. On the outer circumferential side of the bypass hole 18*a*, the first arcuate communicating holes 18*b* that compose the oil passage 35 penetrating through the outer circumferential side wall 183 of the partition wall portion 182 are successively formed from the outer circumferential side of the bypass hole 18*a* to the outer frame portion 17.

Figure 40:
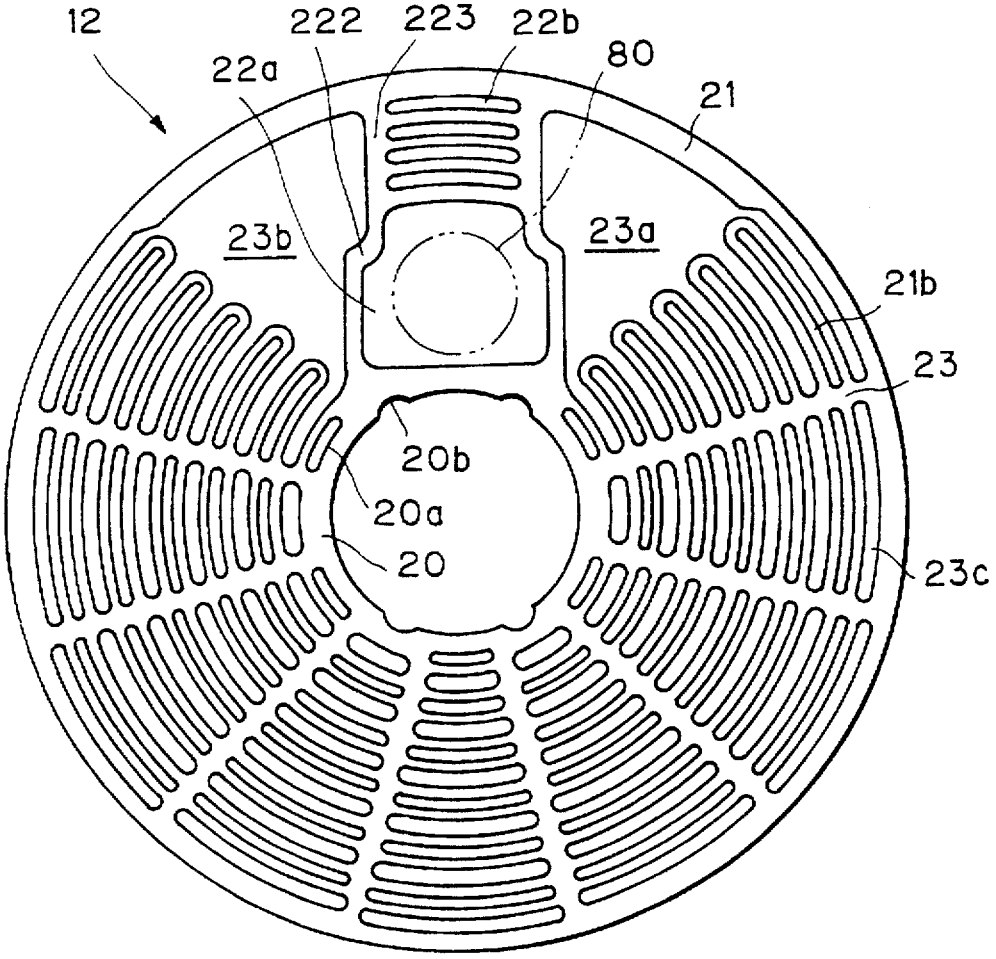

FIG. 40 is a view showing the second formed plate. In a position corresponding to the partition wall portion 182, the second formed plate 12 is provided with a partition wall portion 222 to divide between the second communicating holes 23*a* and 23*b*.

On the inner circumferential periphery side of this partition wall portion 222, a protrusion-shaped bypass hole 22*a* in which engine oil flows is formed in such a manner that it penetrates through the partition wall portion 222 in the thickness direction. This bypass hole 22*a* is open in a position corresponding to the bypass hole 18*a* so that the bypass hole 22*a* communicates with the bypass hole 18*a*. In the same manner as the bypass hole 18*a*, the relief valve 80 shown by a two-dotted chain line in the drawing is provided in the bypass hole 22*a*.

The first arcuate communicating holes 22*b* penetrating through the outer circumferential side wall 223 of the partition wall portion 222 are successively formed on the outer circumferential side of the bypass hole 22*a* from the outer circumference to the outer frame portion 21. These first communicating holes 22*b* are open in a position corresponding to each of the first communicating holes 18*b* so that they communicate with each of the first communicating holes 18*b*.

Figure 41:
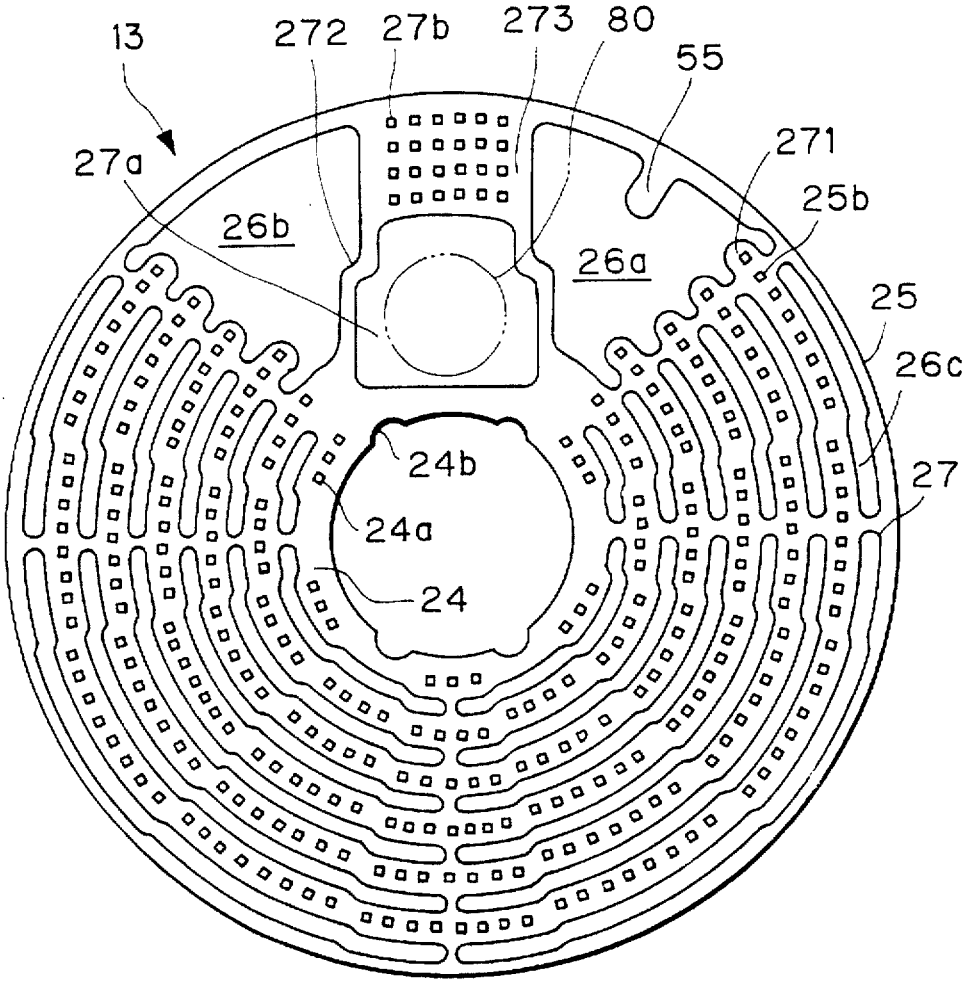

FIG. 41 is a view showing a fin plate. The fin plate 13 forms a partition wall portion 272 to divide between the second communicating holes 26*a* and 26*b* in a position corresponding to the partition wall portions 182 and 222.

On the inner circumferential periphery side of this partition wall portion 272, a protrusion-shaped bypass hole 27*a* in which engine oil flows is formed in such a manner that it penetrates through the partition wall portion 272 in the thickness direction. This bypass hole 27*a* is open in a position corresponding to the bypass holes 18*a* and 22*a* so that the bypass hole 27*a* communicates with the bypass holes 18*a* and 22*a*. In the same manner as the bypass holes 18*a* and 22*a*, the relief valve 80 shown by a two-dotted chain line in the drawing is provided in the bypass hole 27*a*.

The first arcuate communicating holes 27*b* penetrating through the outer circumferential side wall 273 of the partition wall portion 272 are successively formed on the outer circumferential side of the bypass hole 27*a* from the outer circumference to the outer frame portion 25. These first communicating holes 27*b* are open in a position corresponding to each of the first communicating holes 18*b* and 22*b* so that they communicate with each of the first communicating holes 18*b* and 22*b*. In this case, when a plurality of partition walls 182, 222 and 272 are stacked, a partition pipe portion 811 is formed.

Figure 42:
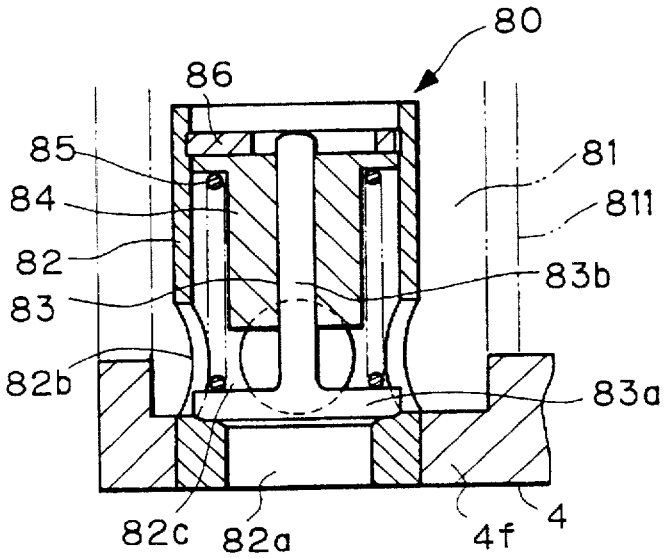
Figure 43:
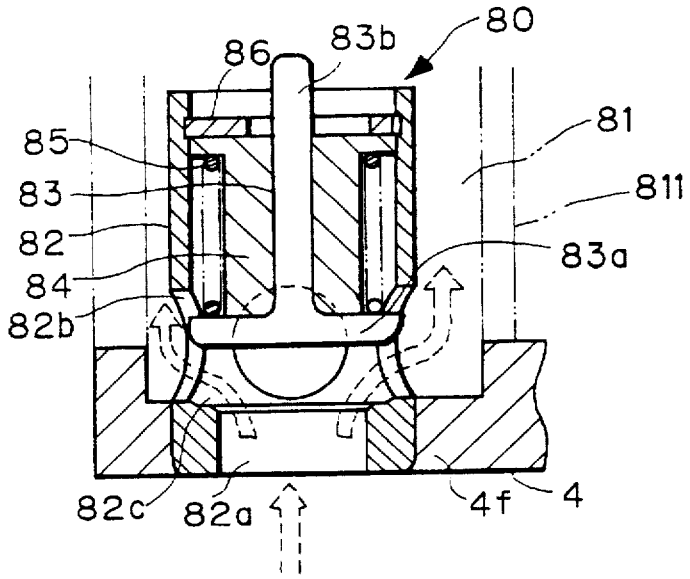

FIGS. 42 and 43 show a relief valve. The relief valve 80 includes a cylindrical valve main body 82, valve body 83 slidably displaced in the valve main body 82, guide 84 to restrict the motion of this valve body 83, and spring 85 to return the valve body 83 to the initial position.

The valve main body 82 is made of a metal such as an aluminum alloy, and is formed as a cylinder. This valve main body 82 includes a circular inlet portion 82*a* formed in the lower end portion that is engaged with the holding portion 4*f* of the lower end bracket 4, and a circular outlet portion 82*b* communicating with the bypass passage 81 of the heat exchanging section 7 wherein the circular outlet portion 82*b* is formed on the side wall portion. In the valve main body 82, a bypass passage 82*c* to enable the inlet portion 82*a* to communicate with the outlet portion 82*b* is formed.

The valve body 83 is made of a metal such as an aluminum alloy, and includes a disk portion 83*a* to open and close the inlet portion 82*a*, and a rod portion 83*b* extending upward in the drawing as compared with the disk portion 83*a*.

The guide 84 is made of a metal such as an aluminum alloy, and is formed approximately in a pipe shape. The guide 84 is held by an annular holding wall 86 provided onto the inner circumferential side of the valve main body 82, and guides the rod portion 83*b* in the axial direction so that the valve body 83 can be displaced vertically in the drawing.

The upper end of the spring 85 is held by the guide 84 in the drawing, and the lower end in the drawing is held by the disk portion 83*a* of the valve body 83 so that the spring 85 sets the valve opening pressure of the valve body 83.

Referring to FIGS. 36 to 38, and 43, a method of assembling the relief valve to the oil cooler will be explained.

The oil cooler 1 is manufactured in the following manner: the fin plate 13 is provided between the first and second formed plates 11 and 12 so as to form the joined body 8; a plurality of joined bodies are stacked so as to form a stacked body; the upper end bracket 5 is assembled to the upper end portion of the stacked body, and the lower end bracket 4 is assembled to the lower end; and for example, the stacked body is put into a furnace so that the stacked body is integrally joined by means of brazing.

After that, the upper end portion of the relief valve 80 is inserted into the lower end portion of the oil cooler 1, that is, the upper end portion of the relief valve 80 is inserted through the inlet opening portion 4*f* formed in the lower end bracket 4, and then the relief valve 80 is press-fitted into the oil cooler 1 so that the lower end surface of the lower end bracket 4 and the lower end surface of the valve main body 82 can be located on the same surface.

As described above, after the oil cooler 1 has been integrally brazed, the relief valve 80 is assembled onto the holding portion 4*f* of the lower end bracket 4 by means of press-fitting. Therefore, the spring 85 is not annealed when the oil cooler 1 is integrally brazed. For that reason, the spring characteristics of the spring 85 are not changed. Accordingly, the valve opening pressure of the valve body 83 that is set by the spring 85 is not affected at all, so that the valve body 83 is opened by a predetermined valve opening pressure.

Referring to FIGS. 36 to 43, the operation of this oil cooler 1 will be explained.

Engine oil to lubricate the sliding portions of the engine 2 reaches the inlet opening 82*a* of the relief valve 80 press-fitted into the lower end side bracket 4 through the outflow passage 2*a* formed in the engine 2. At this time, in the inlet opening 82*a*, the pressure directed upward in the drawing is received by the disk portion 83*a* of the valve body 83 of the relief valve 80. In the case where the pressure is lower than the valve opening pressure previously set by the spring 85, the valve body 83 closes the inlet portion 82*a* as shown in FIG. 42. Therefore, engine oil does not flow into the bypass passage 81, but flows into a plurality of oil passages 35 of the heat exchanging section 7 from a plurality of inlet opening portions 4b formed in the lower end bracket 4.

On the contrary, in the case where the pressure received by the disk portion 83a of the valve body 83 is higher than the valve opening pressure previously set by the spring 85, the valve body 83 opens the inlet portion 82a, and engine oil flows into the bypass passage 81 as shown by a broken line in FIG. 43. At this time, pressure loss of the plurality of oil passages 35 is remarkably larger than that of the bypass passage 81, so that almost all engine oil passes through the bypass passage 81 and flows out to the upper end bracket 5. Therefore, when a pressure higher than the valve opening pressure previously set by the spring 85 is applied to the oil cooler 1, engine oil can pass through not only the plurality of oil passages 35 but also the bypass passage 81, so that the pressure load given to the oil cooler 1 can be reduced. As a result of the foregoing, damage to the heat exchanging section 7 of the oil cooler 1 can be prevented. Further, the cooling water passage 36 can be divided by the plurality of stacked partition walls 182, 222 and 272 to accommodate the relief valve 80.

Figure 44:
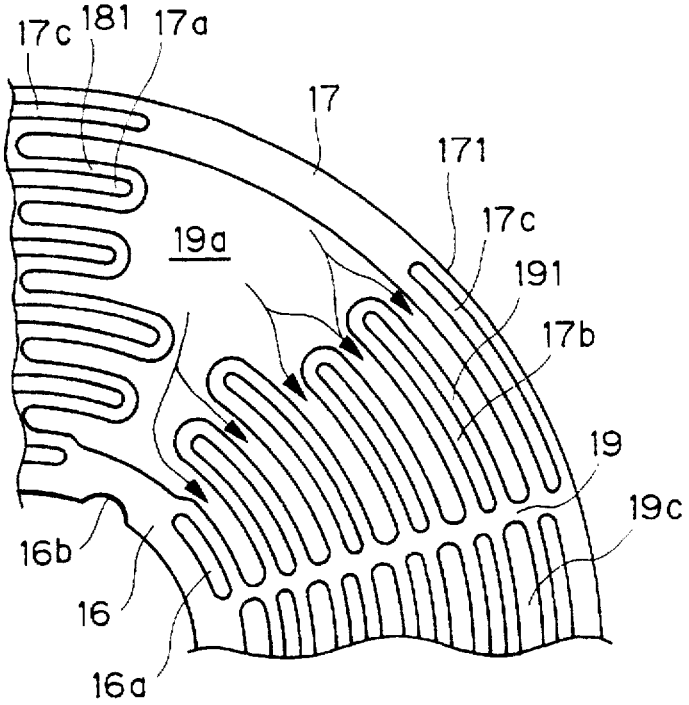
FIG. 44 is a plan view showing the first formed plate of the twelfth embodiment.

FIG. 44 is a view showing the twelfth embodiment of the present invention. The first formed plate is shown in FIG. 4.

This first formed plate 11 is made of a metal such as an aluminum alloy. In this embodiment, when the arc portions 181, 191 of the sixth row in the first embodiment are made to be the outer frame portion 17, the dimensions in the radial direction are made smaller than those of the first formed plate 11 in the first embodiment. The plurality of first communicating holes 17c are formed in the outer frame portion 17 in such a manner that the first communicating holes 17c penetrate through the outer frame portion 17 in the thickness direction. The first communicating holes 17c are provided on the outer circumferential side compared with the second communicating holes 19c disposed on the outermost circumferential side.

When the first formed plate 11 is structured in the aforementioned manner, the following advantages can be provided. In the case where there is a possibility that the atmosphere (for example, air containing a snow melting agent) or cooling water (for example, sea water in the case of an oil cooler 1 for use in a marine vessel) of the outer circumferential wall 171 may corrode the material of the heat exchanging section of the oil cooler 1, the influence from the cooling water of the outer circumferential wall 171 of the outer frame portion 17 can be eliminated when the first communicating holes 17c in which engine oil flows are provided adjoining the inner circumferential side of the outer circumferential wall 171 of the outer frame portion 17. Therefore, the outer circumferential wall 171 of the outer frame 17 is only affected by the atmosphere, so that the occurrence of damage caused by corrosion can be reduced.

Also, the angle of the connecting wall portion between the second formed plate 12 and the fin plate 13 may be shifted in the same manner.

VARIATIONS

Although the fin plate is provided between the formed plates in this embodiment, the fin plate may be eliminated. The configuration of the formed plate is not limited to this specific embodiment, but it may be changed to any optional configuration.

Although the oil cooler and oil filter are connected with each other in the stacking direction of the joined body, they may be connected in the surface direction of the joined body, and the oil cooler and oil filter may be connected through an oil pipe and others.

In this embodiment, the present invention is applied to an oil cooler, however, the present invention may be applied to other heat exchangers such as a water medium heat exchanger in which the medium is heated or cooled using engine cooling water.

Figure 45:
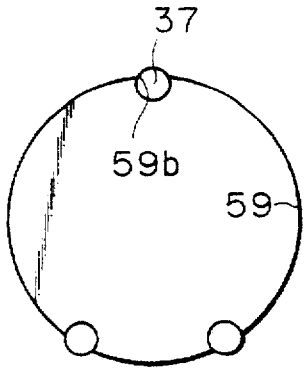
FIG. 45 is a schematic illustration showing a variation of the groove portion for positioning the inner frame portion.
Figure 46:
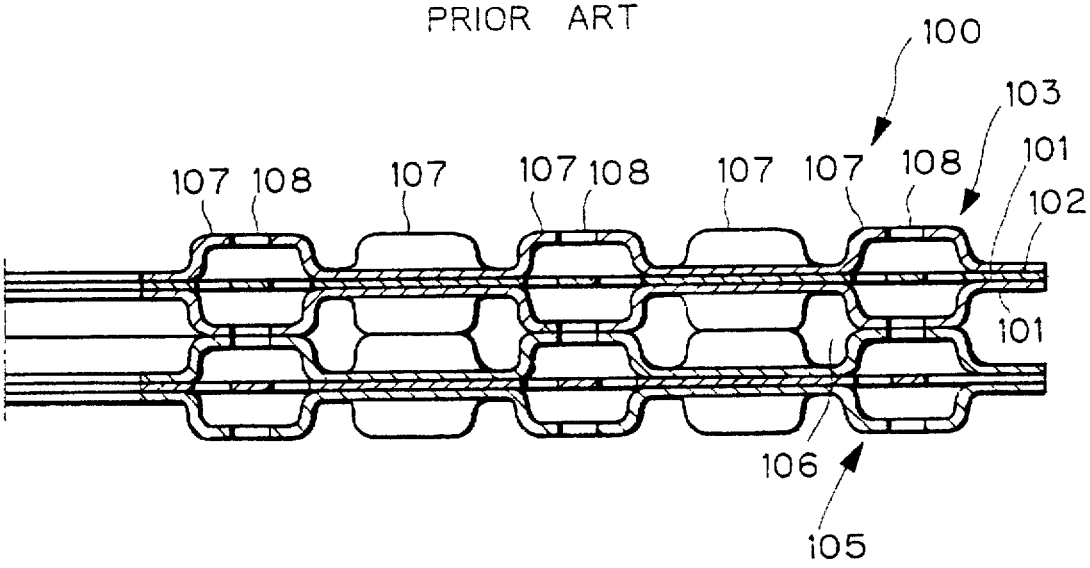
Fig. 46 PRIOR ART
FIG. 46 is a sectional view showing a heat exchanging section known in the prior art.

Although four groove portions for positioning are provided on the inner circumference of the inner frame portion in this embodiment, three groove portions 59b for positioning may be provided on the inner circumference of the inner frame 59 as shown in FIG. 45 may be provided. Two or less or five or more such groove portions may be provided. Further, the plate may be positioned by not less than one projection provided on the outer circumference of a pipe-shaped structure.

As mentioned above, according to the first aspect of the present invention, no bent portion is provided in the flat plate. Therefore, it is possible to form a larger number of flow pipes in the same volume, so that the heat exchanging area of the flow pipe can be increased. Also, no structure is provided to block the flow of the first heating medium in the extending direction of the flow pipe. Accordingly, the velocity of flow of the first heating medium can be increased in a portion close to the wall surface. Therefore, the heat exchanging efficiency between the first and second heating mediums can be improved.

According to a second aspect of the present invention, there is provided no structure to block the flow of the first heating medium in the extending direction of the flow pipe. Accordingly, the velocity of flow of the first heating medium can be increased in a portion close to the wall surface. Therefore, the heat exchanging efficiency between the first and second heating mediums can be improved.

We claim:

1. A heat exchanger comprising:

a plurality of flat plates, wherein each flat plate of said plurality of flat plates has:

a plurality of first communicating holes penetrating therethrough in a thickness direction; and a plurality of second communicating holes penetrating therethrough along the same direction as said first communicating holes, said second communicating holes adjoining said first communicating holes through plate wall portions;

said plurality of flat plates being stacked and being aligned so that said first communicating holes of said plurality of flat plates are communicated with each other in the stacking direction and said second communicating holes of said plurality of flat plates are communicated with each other in the stacking direction, wherein said first and second communicating holes are alternately arranged along a radially outward extending line on each said flat plate, wherein a plurality of flow pipes in which a first heating medium flows are defined by said first communicating holes in said stacked plurality of flat plates, and a plurality of flow passages in which a second heating medium flows around said flow pipes are defined by said second communicating holes in said stacked plurality of flat plates, such that heat is exchangeable between the first and the second heating mediums, wherein each said flat plate has an inlet hole formed therethrough in a thickness direction of said flat plate, said inlet hole communicating with at least some of said flow passages, wherein said inlet holes in said stacked plurality of flat plates collectively define an inlet chamber for said second medium extending in the stacking direction of said stacked flat plates;

wherein each said flat plate has an outlet hole formed therethrough in a thickness direction of said flat plate, said outlet hole communicating with at least some of said flow passages, wherein said outlet holes in said stacked plurality of flat plates collectively define an outlet chamber for said second heating medium extending in the stacking direction of said stacked flat plates, wherein said second heating medium flows from said inlet chamber to said outlet chamber by way of said plurality of flow passages, wherein each said flat plate includes an approximately annular inner frame portion defining an inner flat plate wall portion on an inner circumferential periphery side thereof, and an approximately annular outer frame portion defining an outer plate wall portion on an outer circumferential periphery side thereof, wherein a plurality of flat first arc portions and second arc portions are radially provided between said inner frame portion and said outer circumferential periphery side, wherein one said first communicating hole is formed in each said first arc portion in the thickness direction so that said first communicating hole is surrounded by said first arc portion, wherein said second communicating hole is formed between adjacent said first arc portions, wherein said plurality of flat plates includes a plurality of first flat plates and a plurality of second flat plates, wherein each first flat plate of said plurality of first flat plates is joined to a respective second flat plate of said plurality of second flat plates to form a plurality of joined bodies, said plurality of joined bodies being stacked to form a stacked body, wherein each said first flat plate includes a first connection member that interconnects said plurality of second arc portions in radial and circumferential directions, and said second flat plate includes a second connection member that interconnects said plurality of second arc portions in radial and circumferential directions, said first and second connection members having different positions in each said joined body, wherein at least some of said joined bodies include a fin plate interposed between said first and second flat plates, wherein said fin plate has a first communicating aperture substantially aligned with said first communicating holes of said first and second flat plates, and a second communicating opening aligned with said second communicating holes of said first and second flat plates, said second communicating opening being adjacent to the first communicating aperture through a plate wall portion, and wherein the second communicating holes of the first flat plate and the second communicating holes of the second flat plate of the stacked body partially overlap so that the second heating medium flows in the flow passages defined by the second communicating holes in the stacking direction as well as in the circumferential direction.

2. A heat exchanger according to claim 1, wherein said plurality of flat plates includes an end plate located at an axial endmost position of said stacked body, said end plate having first communicating holes formed therethrough which communicate with at least some of said plurality of first communicating holes, and communicating ports formed therethrough which communicate with at least some of said plurality of second communicating holes.

3. A heat exchanger according to claim 1, wherein said plurality of flat plates includes an end plate located at an axial endmost position of said stacked body, said end plate including first communicating holes formed therethrough which communicate with at least some of said first communicating holes.

4. A heat exchanger according to claim 2, wherein a bracket is joined onto one end surface of said stacked body to attach said stacked body to a portion where said body is to be attached.

5. A heat exchanger according to claim 4, wherein said bracket includes a blocking portion to block said communicating ports.

6. A heat exchanger according to claim 1, wherein said fin plate includes an approximately annular inner frame portion defining an inner plate wall portion on an inner circumferential periphery side and an approximately annular outer frame portion defining an outer plate wall portion on an outer circumferential periphery side.

7. A heat exchanger according to claim 6, wherein said fin plate has annular arc portions radially provided therein between said inner frame portion and said outer frame portion, wherein a plurality of first communicating apertures are provided in each arc portion in the thickness direction thereof in such a manner that the plurality of first communicating apertures are surrounded by said arc portion, and said second communicating opening is formed between adjacent said arc portions.

8. A heat exchanger according to claim 1, wherein said fin plate includes a fin plate connection member that interconnects said arc portions in radial and circumferential directions in a position corresponding to said first or second connection member of said first and second plates, respectively.

9. A heat exchanger according to claim 1, wherein one side portion and another side portion of said fin plate are formed nonsymmetrically with respect to an imaginary diametrical line passing through a center of said fin plate.

10. A heat exchanger according to claim 9, wherein said fin plates are stacked with said flat plates so that front and reverse sides of said fin plates alternately face one end of the stack.

11. A heat exchanger according to claim 1, wherein said stacked body is an oil cooler constructed and arranged to cool engine oil by exchanging heat between engine oil and cooling water.

12. A heat exchanger according to claim 11, wherein said stacked body includes a plurality of oil passages in which engine oil flows, a bypass passage that bypasses engine oil from the plurality of oil passages, and a relief valve provided in the bypass passage, wherein the relief valve opens when the pressure of engine oil flowing into the plurality of oil passages is raised to at least a predetermined value.

13. A heat exchanger according to claim 1, wherein said flat plates are made of an aluminum alloy in which engine oil flows in the plurality of first communicating holes and cooling water flows in the plurality of second communicating holes, and wherein the first communicating holes disposed on an outermost peripheral side are provided outside of the second communicating holes disposed on an outermost peripheral side.

* * * * *